US012078168B2

(12) United States Patent
Akiyama et al.

(10) Patent No.: US 12,078,168 B2
(45) Date of Patent: Sep. 3, 2024

(54) COMPRESSOR AND METHOD FOR MANUFACTURING COMPRESSOR

(71) Applicant: DENSO CORPORATION, Kariya (JP)

(72) Inventors: Yoshitaka Akiyama, Kariya (JP); Yasuhiro Oki, Kariya (JP); Tadashi Hotta, Kariya (JP); Toyohiro Kanou, Kariya (JP); Yuu Sugimoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 18/157,261

(22) Filed: Jan. 20, 2023

(65) Prior Publication Data

US 2023/0151813 A1 May 18, 2023

Related U.S. Application Data

(63) Continuation of application No. PCT/JP2021/026024, filed on Jul. 9, 2021.

(30) Foreign Application Priority Data

Aug. 5, 2020 (JP) ..... 2020-133286

(51) Int. Cl.
*F04C 18/02* (2006.01)
*F04C 29/00* (2006.01)

(52) U.S. Cl.
CPC ..... *F04C 18/0215* (2013.01); *F04C 29/005* (2013.01); *F04C 2230/603* (2013.01); *F04C 2240/52* (2013.01); *F04C 2240/60* (2013.01)

(58) Field of Classification Search
CPC ..... F04C 18/0215; F04C 2230/603; F04C 2240/30; F04C 2240/52; F04C 2240/60; F04C 23/008; F04C 29/005
See application file for complete search history.

(56) References Cited

U.S. PATENT DOCUMENTS 4,753,582 A 6/1988 Morishita et al.
4,840,549 A 6/1989 Morishita et al.
(Continued)

FOREIGN PATENT DOCUMENTS

CN 104160153 B * 11/2016 ..... F04C 18/0215
CN 209012052 U * 6/2019
(Continued)

OTHER PUBLICATIONS

CN-104160153-B English Translation (Year: 2016).*
CN-209012052-U English Translation (Year: 2019).*

*Primary Examiner* — Anthony Ayala Delgado
(74) *Attorney, Agent, or Firm* — Oliff PLC

(57) ABSTRACT

A compressor includes a compression mechanism, an electric motor unit, a drive shaft and a housing. A portion of the drive shaft, which is located on one side in an axial direction, is rotatably supported by a main bearing, which is formed integrally in one-piece with or is fixed to a main bearing member of the compression mechanism. Another portion of the drive shaft, which is located on another side in the axial direction, is rotatably supported by a sub-bearing, which is formed integrally in one-piece with or is fixed to an inside of a body portion of a sub-bearing member. The sub-bearing member is formed separately from the housing and is fixed to a bottom surface of a bottom portion of the housing.

6 Claims, 9 Drawing Sheets

(56) References Cited

U.S. PATENT DOCUMENTS

| | | | | |
|---|---|---|---|---|
| 6,247,909 | B1 | 6/2001 | Williams et al. | |
| 6,280,155 | B1 * | 8/2001 | Dreiman | F04C 23/008 417/410.5 |
| 2007/0201996 | A1 * | 8/2007 | Gopinathan | F04C 23/008 418/55.1 |
| 2019/0301464 | A1 | 10/2019 | Kuma et al. | |
| 2021/0324857 | A1 | 10/2021 | Kuma et al. | |

FOREIGN PATENT DOCUMENTS

| | | | |
|---|---|---|---|
| JP | 6225626 | B2 | 11/2017 |
| JP | 2020-020291 | A | 2/2020 |

* cited by examiner

COMPRESSOR AND METHOD FOR MANUFACTURING COMPRESSOR

CROSS REFERENCE TO RELATED APPLICATIONS

This application is a continuation application of International Patent Application No. PCT/JP2021/026024 filed on Jul. 9, 2021, which designated the U.S. and claims the benefit of priority from Japanese Patent Application No. 2020-133286 filed on Aug. 5, 2020. The entire disclosures of all of the above applications are incorporated herein by reference.

TECHNICAL FIELD

The present disclosure relates to a compressor, which is configured to compress suctioned fluid and discharge the compressed fluid, and a method for manufacturing the compressor.

BACKGROUND

A previously proposed compressor includes: a compression mechanism; an electric motor unit; a drive shaft which transmits a drive force outputted from the electric motor unit to the compression mechanism; and a housing, which receives the compression mechanism. A portion of the drive shaft, which is located on one side in an axial direction, is rotatably supported by a main bearing, which is formed at a main bearing member of the compression mechanism. Another portion of the drive shaft, which is located on another side in the axial direction, is rotatably supported by a sub-bearing, which is formed at an inside of a body portion of a sub-bearing member, while the body portion is shaped in a tubular form. The housing includes a housing main body which is shaped in a bottomed tubular form and has an opening on the one side in the axial direction. The sub-bearing member is formed integrally with a bottom surface of a bottom portion of the housing main body.

SUMMARY

This section provides a general summary of the disclosure, and is not a comprehensive disclosure of its full scope or all of its features.

According to one aspect of the present disclosure, there is provided a compressor including: a compression mechanism that is configured to compress fluid; an electric motor unit that is configured to output a drive force which drives the compression mechanism; a drive shaft that is configured to transmit the drive force, which is outputted from the electric motor unit, to the compression mechanism; and a housing that receives the compression mechanism, the electric motor unit and the drive shaft. The housing includes a first housing, which is shaped in a bottomed tubular form and has an opening on one side in an axial direction of the drive shaft, and a second housing, which covers the opening of the first housing. A portion of the drive shaft, which is located on the one side in the axial direction, is rotatably supported by a main bearing. Another portion of the drive shaft, which is located on another side in the axial direction, is rotatably supported by a sub-bearing, which is formed integrally in one-piece with or is fixed to an inside of a body portion of a sub-bearing member, while the body portion is shaped in a tubular form. The sub-bearing member is formed separately from the first housing and is fixed to a bottom surface of a bottom portion of the first housing.

According to another aspect of the present disclosure, there is provided a method for manufacturing the compressor, including: coaxially aligning a central axis of the sub-bearing and a central axis of an inner circumferential surface of an insertion section of the tubular portion, wherein the insertion section is a section of the tubular portion to which the compression mechanism is inserted; and fixing the sub-bearing member to an inner surface of the bottom portion of the first housing in a state where the central axis of the sub-bearing and the central axis of the inner circumferential surface of the insertion section are coaxially aligned.

BRIEF DESCRIPTION OF DRAWINGS

The drawings described herein are for illustrative purposes only of selected embodiments and not all possible implementations, and are not intended to limit the scope of the present disclosure.

DETAILED DESCRIPTION

Figure 1:
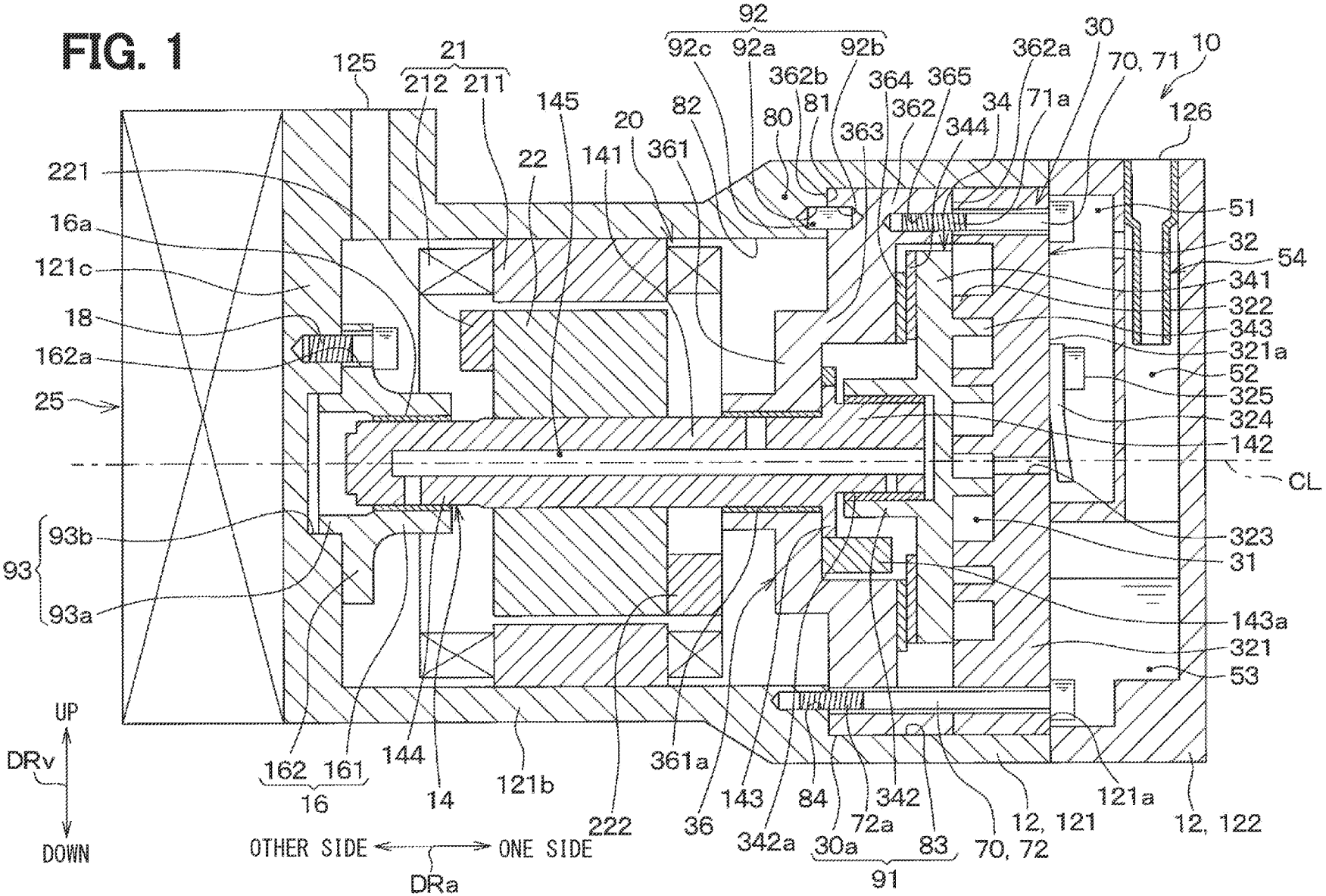
FIG. 1 is a schematic cross-sectional view of a compressor according to a first embodiment.
Figure 2:
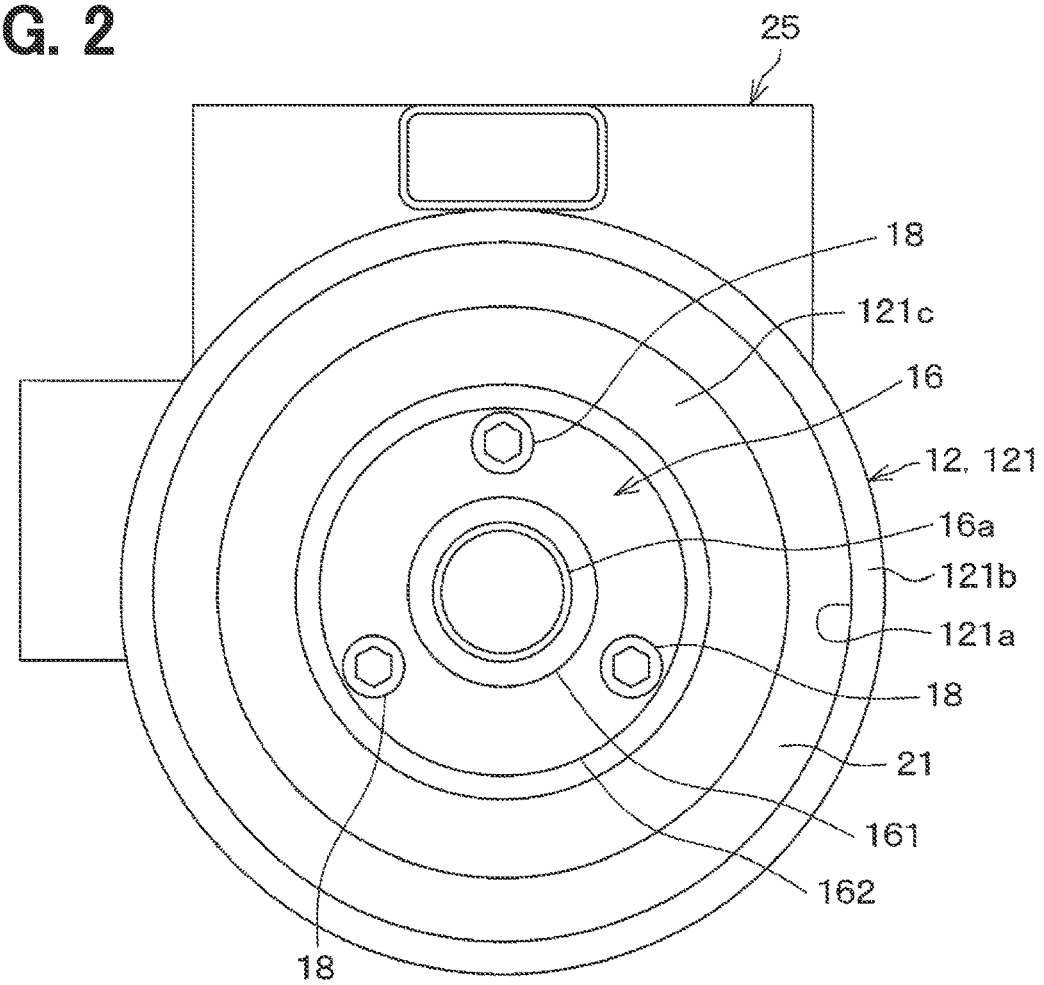
FIG. 2 is a schematic view showing a bottom surface of a first housing and a sub-bearing member.

A previously proposed compressor includes: a compression mechanism; an electric motor unit; a drive shaft which transmits a drive force outputted from the electric motor unit to the compression mechanism; and a housing, which receives the compression mechanism. A portion of the drive shaft, which is located on one side in an axial direction, is rotatably supported by a main bearing, which is formed at a main bearing member of the compression mechanism. Another portion of the drive shaft, which is located on another side in the axial direction, is rotatably supported by a sub-bearing, which is formed at an inside of a body portion of a sub-bearing member, while the body portion is shaped in a tubular form. The housing includes a housing main body which is shaped in a bottomed tubular form and has an opening on the one side in the axial direction. The sub-bearing member is formed integrally with a bottom surface of a bottom portion of the housing main body. An alignment gap for enabling coaxial alignment of a central axis of the main bearing and a central axis of the sub-bearing is formed between the compression mechanism and an inner circumferential surface of a tubular portion of the housing main body.

During an assembling operation of the above compressor, the central axis of the main bearing is detected while displacing the compression mechanism relative to the inner circumferential surface of the tubular portion of the housing main body, and the central axis of the main bearing is coaxially aligned with the central axis of the sub-bearing. Then, the compression mechanism is fixed to the housing main body while maintaining the aligned state of the central axis of the main bearing and the central axis of the sub-bearing.

However, the above operation requires repetitions of the accurate detection of the amount of displacement of the central axis of the main bearing while displacing the compression mechanism. Therefore, the above operation requires high equipment cost and long cycle time and is therefore not suitable for mass-produced products, such as on-vehicle compressors.

In view of the above point, the inventors of the present application have proposed to reduce a size of the gap between the compression mechanism and the housing main body and increase the precision of the coaxiality between a central axis of an insertion section of the housing main body, to which the compression mechanism is inserted, and the central axis of the sub-bearing to coaxially align these axes. According to the study of the inventors of the present application, in order to implement the above structure, it is necessary to precisely process each of the insertion section of the housing main body and the inner circumferential surface of the sub-bearing.

However, in the case where the sub-bearing member, which includes the sub-bearing, is formed integrally with the bottom portion of the housing main body, it is difficult to accurately process the inner circumferential surface of the sub-bearing, and dedicated equipment for processing the inner circumferential surface of the sub-bearing needs to be introduced. For example, in a case where the sub-bearing is a sliding bearing, grinding of the inner circumferential surface of the bearing is carried out using a grindstone that has a length which allows the grindstone to reach from the opening of the housing main body to the bottom portion. In such a case, since the degree of difficulty of polishing is significantly increased by the tendency of whirling of the grindstone during polishing, the introduction of the dedicated equipment is inevitable.

According to one aspect of the present disclosure, there is provided a compressor including:

a compression mechanism that is configured to compress fluid;

an electric motor unit that is configured to output a drive force which drives the compression mechanism;

a drive shaft that is configured to transmit the drive force, which is outputted from the electric motor unit, to the compression mechanism; and a housing that receives the compression mechanism, the electric motor unit and the drive shaft, wherein:

the housing includes a first housing, which is shaped in a bottomed tubular form and has an opening on one side in an axial direction of the drive shaft, and a second housing, which covers the opening of the first housing;

a portion of the drive shaft, which is located on the one side in the axial direction, is rotatably supported by a main bearing, which is formed integrally in one-piece with or is fixed to a main bearing member of the compression mechanism;

another portion of the drive shaft, which is located on another side in the axial direction, is rotatably supported by a sub-bearing, which is formed integrally in one-piece with or is fixed to an inside of a body portion of a sub-bearing member, wherein the body portion is shaped in a tubular form;

the compression mechanism, which includes the main bearing member, is placed at an inside of a tubular portion of the first housing; and the sub-bearing member is formed separately from the first housing and is fixed to a bottom surface of a bottom portion of the first housing.

When the sub-bearing member, which includes the sub-bearing, is formed separately from the first housing, the inner circumferential surface of the sub-bearing can be processed in a state where the sub-bearing member is removed from the housing. Therefore, the inner circumferential surface of the sub-bearing can be processed with high precision without introducing dedicated equipment.

Therefore, in the compressor, which includes the first housing shaped in the bottomed tubular form, the precision of the sub-bearing, which supports the drive shaft at the bottom portion of the first housing, can be ensured without introducing the dedicated equipment. As a result, it is possible to achieve both the productivity and the high quality while limiting capital investment.

According to another aspect of the present disclosure, there is provided a method for manufacturing a compressor that includes:

a compression mechanism that is configured to compress fluid;

an electric motor unit that is configured to output a drive force which drives the compression mechanism;

a drive shaft that is configured to transmit the drive force, which is outputted from the electric motor unit, to the compression mechanism; and a housing that receives the compression mechanism, the electric motor unit and the drive shaft, wherein:

the housing includes a first housing, which is shaped in a bottomed tubular form and has an opening on one side in an axial direction of the drive shaft, and a second housing, which covers the opening of the first housing;

a portion of the drive shaft, which is located on the one side in the axial direction, is rotatably supported by a main bearing, which is formed integrally in one-piece with or is fixed to a main bearing member of the compression mechanism;

another portion of the drive shaft, which is located on another side in the axial direction, is rotatably supported by a sub-bearing, which is formed integrally in one-piece with or is fixed to an inside of a body portion of a sub-bearing member, wherein the body portion is shaped in a tubular form;

the compression mechanism, which includes the main bearing member, is placed at an inside of a tubular portion of the first housing; and the sub-bearing member is formed separately from the first housing and is fixed to a bottom surface of a bottom portion of the first housing, the method including:

coaxially aligning a central axis of the sub-bearing and a central axis of an inner circumferential surface of an insertion section of the tubular portion, wherein the insertion section is a section of the tubular portion to which the compression mechanism is inserted; and fixing the sub-bearing member to an inner surface of the bottom portion of the first housing in a state where the central axis of the sub-bearing and the central axis of the inner circumferential surface of the insertion section are coaxially aligned.

According to this method, since the inner circumferential surface of the sub-bearing of the sub-bearing member can be processed before the time of assembling the sub-bearing member to the first housing, the inner circumferential surface of the sub-bearing can be processed with high precision without introducing the dedicated equipment.

Therefore, in the compressor, which includes the first housing shaped in the bottomed tubular form, the precision of the sub-bearing, which supports the drive shaft at the bottom portion of the first housing, can be ensured without introducing the dedicated equipment.

Hereinafter, embodiments of the present disclosure will be described with reference to the drawings. In the following embodiments, the same reference signs may be assigned to portions that are the same as or equivalent to those described in the preceding embodiment(s), and the description thereof may be omitted. Further, when only a portion of any one of the components is described in the embodiment, the description of the component described in the preceding embodiment can be applied to the rest of the component. The following embodiments may be partially combined with each other as long as the combination does not cause any trouble, even if not explicitly stated.

First Embodiment

The present embodiment will be described with reference to FIGS. 1 to 5. In the present embodiment, there will be described an example in which a compressor 10 of the present disclosure is applied as an on-vehicle compressor of a refrigeration cycle device for a vehicle air conditioning device.

The refrigeration cycle device forms a vapor compression refrigeration cycle. The refrigeration cycle device includes: the compressor 10 that compresses and discharges refrigerant which is fluid; a radiator that radiates heat from the refrigerant discharged from the compressor 10; a decompression device that decompresses the refrigerant discharged from the radiator; and an evaporator that evaporates the refrigerant decompressed by the decompression device. A main component of the refrigerant used in the refrigeration cycle device is carbon dioxide. The carbon dioxide shifts to a supercritical state at a lower temperature than fluorocarbon refrigerant. The refrigerant is mixed with lubricant oil, which lubricates respective sliding portions at the inside of the compressor 10. A portion of the lubricant oil is circulated in the cycle along with the refrigerant. Here, it should be noted that the refrigerant may be fluorocarbon refrigerant.

The compressor 10 will be described with reference to FIG. 1. FIG. 1 is an axial cross-sectional view showing a cross-section taken along a central axis CL of a drive shaft 14 of the compressor 10. A double-sided arrow, which indicate up and down in FIG. 1, indicates an up-to-down direction DRv in a state where the compressor 10 is installed on the vehicle. An arrow DRa in FIG. 1 indicates an axial direction DRa of the drive shaft 14.

As shown in FIG. 1, the compressor 10 includes a housing 12, the drive shaft 14, an electric motor unit 20, an inverter 25 and a compression mechanism 30. The drive shaft 14, the electric motor unit 20 and the compression mechanism 30 are received at the inside of the housing 12. The compressor 10 is an electric compressor. The electric motor unit 20 serves as a drive source to rotate the drive shaft 14. The compression mechanism 30 is driven in response to rotation of the drive shaft 14. The compressor 10 has a horizontal structure in which the central axis CL of the drive shaft 14 extends in an approximately horizontal direction, and the compression mechanism 30 and the electric motor unit 20 are arranged side by side in the approximately horizontal direction. The approximately horizontal direction is a direction that intersects the gravitational direction.

The housing 12 forms an outer shell of the compressor 10. The housing 12 includes a first housing 121 and a second housing 122. The first housing 121 and the second housing 122 are made of aluminum or an aluminum alloy.

The first housing 121 is shaped in a bottomed tubular form and has an opening on one side in the axial direction DRa of the drive shaft 14. In other words, the first housing 121 is shaped in a cup form that has a U-shaped cross-section. Specifically, the first housing 121 has: a tubular portion 121*b*, which is shaped in a cylindrical tubular form; and a bottom portion 121*c*. The tubular portion 121*b* has an opening 121*a* on the one side in the axial direction DRa. The bottom portion 121*c* is joined to an end part of the tubular portion 121*b* which is located on the other side in the axial direction DRa. In the first housing 121, the tubular portion 121*b* and the bottom portion 121*c* are integrally formed in one-piece as a seamless integral article. A part of an outer surface of the bottom portion 121*c* is planar to enable close contact of the inverter 25 to the part of the outer surface of the bottom portion 121*c*.

The first housing 121 is shaped in a stepped form where a stepped portion 80 is formed at the tubular portion 121*b*. Specifically, the first housing 121 has a first inner circumferential surface 82, a second inner circumferential surface 83 and a step surface 81. The first inner circumferential surface 82, the step surface 81 and the second inner circumferential surface 83 are arranged in order of decreasing distance from the bottom portion 121*c*. In other words, the first inner circumferential surface 82, the step surface 81 and the second inner circumferential surface 83 are arranged in order of increasing distance from the opening 121*a*. The first inner circumferential surface 82 and the second inner circumferential surface 83 are respectively formed in a cylindrical shape such that the first inner circumferential surface 82 and the second inner circumferential surface 83 are concentric on the central axis CL of the drive shaft 14. The first inner circumferential surface 82 is a section of the first housing 121, at which the electric motor unit 20 is placed. The first inner circumferential surface 82 is cylindrical. The second inner circumferential surface 83 is located on the one side of the first inner circumferential surface 82 in the axial direction DRa. The second inner circumferential surface 83 is cylindrical. The second inner circumferential surface 83 is an inner circumferential surface of an insertion section of the first housing 121, to which the compression mechanism 30 is inserted. An outer diameter of the compression mechanism 30 is larger than an outer diameter of the electric motor unit 20. Therefore, a diameter of the second inner circumferential surface 83 is larger than a diameter of the first inner circumferential surface 82. The step surface 81 connects between the first inner circumferential surface 82 and the second inner circumferential surface 83. The step surface 81 extends in a direction perpendicular to the axial direction DRa. The step surface 81 directly contacts a bearing fixing portion 362 of a main bearing member 36 described later. Here, it should be noted that the step surface 81 may contact the bearing fixing portion 362 through an intervening component. The insertion section of the tubular portion 121*b*, to which the compression mechanism 30 is inserted, is a section of the tubular portion 121*b* that is located on the one side (i.e., the opening 121*a* side) of the step surface 81 in the axial direction DRa.

In the first housing 121, the compression mechanism 30, which includes the main bearing member 36, is placed at the inner circumferential surface of the tubular portion 121*b*, and the sub-bearing member 16, which includes a body portion 161 shaped in a tubular form, is fixed to the bottom portion 121*c*. In the first housing 121 of the present embodiment, the tubular portion 121*b* serves as a tubular portion of the first housing 121, and the bottom portion 121*c* serves as a bottom portion of the first housing 121.

The second housing 122 is located on the one side of the first housing 121 in the axial direction DRa and covers the opening of the first housing 121. The second housing 122 is securely fixed to the first housing 121 by lid bolts (not shown). A seal member (not shown) is interposed between an end part of the first housing 121, which is located on the one side in the axial direction DRa, and the second housing 122. Thus, the housing 12 is sealed.

The electric motor unit 20 is a three-phase AC motor that is driven by an electric power supplied from the inverter 25. The electric motor unit 20 is formed as an inner rotor motor, in which a rotor 22 is placed on an inner side of a stator 21.

The stator 21 includes a stator core 211, which is made of a magnetic material, and coils 212, which are wound around the stator core 211. When the electric power is supplied from the inverter 25, the stator 21 generates a rotating magnetic field for rotating the rotor 22. The stator 21 is fixed to the first inner circumferential surface 82 of the tubular portion 121*b* by thermal shrink fit.

The rotor 22 is shaped in a cylindrical tubular form, and the drive shaft 14 is fixed to an inner periphery of the rotor 22 by, for example, press-fitting. Permanent magnets (not shown) are arranged at an inside of the rotor 22. Balance weights 221, 222 are installed to two opposite side surfaces, respectively, of the rotor 22 to offset the imbalance of eccentric rotation of, for example, an orbiting scroll 34.

The inverter 25 is a device that supplies the electric power to the stator 21. The inverter 25 is installed to an outside of the housing 12. Specifically, the inverter 25 is installed to the outer surface of the bottom portion 121*c* of the first housing 121.

In the electric motor unit 20 configured in the above-described manner, when the rotating magnetic field is generated around the stator 21 in response to the supply of the electric power from the inverter 25 to the stator 21, the rotor 22 and the drive shaft 14 are integrally rotated.

Here, electrical wirings (not shown) of the inverter 25 and electric wirings (not shown) of the electric motor unit 20 are electrically connected with each other through airtight terminals (not shown) installed at the bottom portion 121*c* of the first housing 121. Therefore, the housing 12 has a sealed structure.

The first housing 121 of the housing 12 has a suction port 125, through which low pressure refrigerant passed through the evaporator is suctioned. Specifically, at the first housing 121, the suction port 125 is located on the other side of the electric motor unit 20 in the axial direction DRa. A suction pipe (not shown), which is connected to the evaporator, is connected to the suction port 125.

The low-pressure refrigerant, which has passed through the evaporator, is suctioned from the suction port 125 into the inside of the housing 12 where the electric motor unit 20 is placed. The low-pressure refrigerant, which is suctioned into the inside of the housing 12, is suctioned into the inside of the compression mechanism 30 through a suction port (not shown) of the compression mechanism 30. For this reason, the inside of the housing 12, in which the electric motor unit 20 is placed, has a low temperature atmosphere. In this way, the electric motor unit 20 and the inverter 25 can be cooled. Particularly, the inverter 25 is installed to the planar section of the bottom portion 121*c*, so that even when the inverter 25 generates heat during its operation, the generated heat can be efficiently conducted to the bottom portion 121*c* to cool the inverter 25. Therefore, the efficiency and the reliability of the electric motor unit 20 and the inverter 25 can be improved.

The second housing 122 of the housing 12 has a discharge port 126, through which high pressure refrigerant compressed by the compression mechanism 30 is discharged from the second housing 122. At the housing 12, the discharge port 126 is located on the one side of the compression mechanism 30 in the axial direction DRa.

Furthermore, a high-pressure muffler chamber 51, an oil separation chamber 52 and a high-pressure oil storage chamber 53 are formed at the inside of the second housing 122. The high-pressure muffler chamber 51 is communicated with a discharge hole 323. The high-pressure muffler chamber 51 is a space for reducing a discharge pressure pulsation of the refrigerant, which is discharged from the discharge hole 323. The oil separation chamber 52 is communicated with the high-pressure muffler chamber 51. The oil separation chamber 52 is a space for separating the lubricant oil from the high-pressure refrigerant supplied from the high-pressure muffler chamber 51. An oil separator 54, which separates the lubricant oil from the high-pressure refrigerant supplied from the oil separation chamber 52, is received in the oil separation chamber 52. The oil separator 54 is shaped in a pipe form. The oil separator 54 is fixed to the discharge port 126 by, for example, press-fitting. The high-pressure oil storage chamber 53 is a space for accumulating the lubricant oil separated by the oil separator 54.

The drive shaft 14 has a one-side portion 141 which is located on the one side of the rotor 22 in the axial direction DRa. The compression mechanism 30 is located on the one side of the electric motor unit 20 in the axial direction DRa of the drive shaft 14. The one-side portion 141 is engaged with the compression mechanism 30. The drive shaft 14 transmits the drive force, which is generated by the electric motor unit 20, to the compression mechanism 30. The one-side portion 141 is rotatably supported by a main bearing 361*a* (described later) of the main bearing member 36 of the compression mechanism 30.

An end portion of the one-side portion 141, which is located on the one side in the axial direction DRa, has an eccentric shaft portion 142 that is eccentric from a rotational center of the drive shaft 14. The eccentric shaft portion 142 forms a crank mechanism for orbiting the orbiting scroll 34 described later. The eccentric shaft portion 142 is rotatably engaged with an eccentric bearing 342*a* (described later) of the orbiting scroll 34. The eccentric shaft portion 142 is formed integrally in one-piece with a main body of the drive shaft 14. Furthermore, the one-side portion 141 has a flange portion 143 which extends in the up-to-down direction DRv. A balance weight 143*a*, which limits eccentric rotation of the drive shaft 14, is provided at the flange portion 143.

The drive shaft 14 has an other-side portion 144 which is located on the other side of the rotor 22 in the axial direction DRa. The other-side portion 144 is rotatably supported by the sub-bearing 16*a* of the sub-bearing member 16. Details of the sub-bearing member 16 will be described later.

An oil supply passage 145, which supplies the lubricant oil to the bearings 16*a*, 342*a*, 361*a*, is formed at an inside of the drive shaft 14. The oil supply passage 145 is communicated with the high-pressure oil storage chamber 53 through an oil flow passage (not shown) which is formed at the stationary scroll 32 and the orbiting scroll 34. With this configuration, the lubricant oil, which is stored in the high-pressure oil storage chamber 53, is supplied to the bearings 16*a*, 342*a*, 361*a* from the oil supply passage 145. Each of the bearings 16*a*, 342*a*, 361*a* is internally and forcefully lubricated.

The compression mechanism 30 includes the stationary scroll 32, the orbiting scroll 34 and the main bearing member 36. The stationary scroll 32 is fixed to the second inner circumferential surface 83 of the tubular portion 121*b* through the main bearing member 36. The orbiting scroll 34 is meshed with the stationary scroll 32 and compresses the refrigerant when the orbiting scroll 34 is driven to make orbiting motion by the drive force of the drive shaft 14. The orbiting scroll 34 and the stationary scroll 32 are arranged next to each other in the axial direction DRa. The orbiting scroll 34 is located on the other side of the stationary scroll 32 in the axial direction DRa. The stationary scroll 32 and the orbiting scroll 34 are made of a steel material or aluminum alloy.

An Oldham ring (not shown) is coupled to the orbiting scroll 34. The Oldham ring forms an anti-rotation mechanism that limits rotation about the eccentric shaft portion 142. The orbiting scroll 34 makes the orbital motion around the central axis (serving as an orbital center) CL of the drive shaft 14 without rotating around the eccentric shaft portion 142 when the drive shaft 14 is rotated. In other words, the orbiting scroll 34 makes the orbiting motion around the central axis CL of the drive shaft 14 when the drive shaft 14 is rotated.

The orbiting scroll 34 has an orbiting base plate 341 that is shaped in a circular disk form. The orbiting base plate 341 has a bearing forming portion 342 which is shaped in a cylindrical tubular form and is formed at a center part of the orbiting base plate 341. The bearing forming portion 342 forms the eccentric bearing 342*a*, which is located at an inside of the bearing forming portion 342 and rotatably supports the eccentric shaft portion 142. The eccentric bearing 342*a* is formed separately from the orbiting base plate 341 and is formed as a sliding bearing.

The stationary scroll 32 has a stationary base plate 321 that is shaped in a circular disk form. The stationary scroll 32 has a stationary wrap 322 that is shaped in a spiral form and projects from the stationary base plate 321 toward the orbiting scroll 34. The orbiting scroll 34 has an orbiting wrap 343 that is shaped in a spiral form and projects from the orbiting base plate 341 toward the stationary scroll 32.

The stationary wrap 322 and the orbiting wrap 343 are meshed with each other at a plurality of locations to form a plurality of operating chambers 31 respectively shaped in a crescent form. In FIG. 1, only one of the operating chambers 31 is indicated with the reference sign for convenience of illustration.

Each of the operating chambers 31 is moved from the outer peripheral side toward the center side while decreasing a volume of the operating chamber 31 in response to the orbiting of the orbiting scroll 34. Although not illustrated, the refrigerant, which is suctioned into the inside of the housing 12 from the suction port 125, is supplied to the operating chamber 31 through a refrigerant supply passage formed at, for example, the main bearing member 36. The refrigerant in the respective operating chambers 31 is compressed when the volume of the operating chamber 31 is reduced.

The discharge hole 323, through which the refrigerant compressed in the operating chamber 31 is discharged, is formed at a center part of the stationary base plate 321. A lead valve (not shown) which forms a check valve for limiting a backflow of the refrigerant to the operating chamber 31, and a stopper 324, which limits a maximum opening degree of the lead valve, are installed at an end surface 321*a* of the stationary base plate 321, which is located on the one side in the axial direction DRa. The lead valve and the stopper 324 are securely fixed to the stationary base plate 321 by a fixture bolt 325.

The main bearing member 36 is a bearing member that includes the main bearing 361*a*. The main bearing member 36 forms a space between the main bearing member 36 and the stationary scroll 32. The eccentric shaft portion 142, the flange portion 143, the balance weight 143*a* and the orbiting scroll 34 are received in this space.

Specifically, the main bearing member 36 includes a bearing forming portion 361, a bearing fixing portion 362 and a connecting portion 363. The bearing forming portion 361, the bearing fixing portion 362 and the connecting portion 363 are seamlessly and continuously formed in one-piece. The bearing forming portion 361 is shaped in a tubular form. The bearing forming portion 361 forms the main bearing 361*a* at the inside of the bearing forming portion 361.

The bearing fixing portion 362 is a portion of the main bearing member 36 which is fixed to the stationary scroll 32. The bearing fixing portion 362 is located on a radially outer side of the orbiting scroll 34 in a radial direction of the drive shaft 14. The bearing fixing portion 362 has an outermost peripheral surface of the main bearing member 36 which has a largest outer diameter at the main bearing member 36. An end surface 362*a* of the bearing fixing portion 362, which is located on the one side in the axial direction DRa, contacts the stationary scroll 32.

The connecting portion 363 connects between the bearing forming portion 361 and the bearing fixing portion 362. The bearing fixing portion 362 is located on the outer side of the bearing forming portion 361 in the radial direction of the drive shaft 14. The connecting portion 363 extends from the bearing forming portion 361 toward the outside in the radial direction of the drive shaft 14.

The main bearing member 36 is shaped in a cylindrical tubular form that has an inner diameter and an outer diameter which are increased stepwise from the other side toward the one side in the axial direction DRa. A minimum inner diameter portion of the main bearing member 36, which has the smallest inner diameter at the main bearing member 36, forms the bearing forming portion 361. A maximum inner diameter portion of the main bearing member 36, which has the largest outer diameter at the main bearing member 36, forms the bearing fixing portion 362. The bearing forming portion 361, the bearing fixing portion 362 and the connecting portion 363 are made of a steel material or aluminum alloy.

The main bearing 361*a* is a sliding bearing. An inner circumferential surface of the main bearing 361*a* is processed in such a manner that a high degree of coaxiality of the inner circumferential surface of the main bearing 361*a* relative to an outer peripheral surface of the bearing fixing portion 362 is achieved. The main bearing 361*a* is fixed integrally to the main bearing member 36. Specifically, the main bearing 361*a* includes: a steel member shaped in a cylindrical tubular form; and a resin layer or the like which is coated to an inner circumferential surface of the steel member. Here, it should be noted that the main bearing 361*a* may be made of the same material as that of the bearing forming portion 361 and may be formed integrally in one-piece with the main bearing member 36.

Two thrust plates 364, 344, which are respectively shaped in a circular ring form, are interposed between the main bearing member 36 and the orbiting scroll 34. Among the thrust plates 364, 344, the thrust plate 364, which is located on the main bearing member 36 side, is fixed to the main bearing member 36. Furthermore, the thrust plate 344, which is located on the orbiting scroll 34 side, is fixed to the orbiting scroll 34 such that the thrust plate 344 and the orbiting scroll 34 integrally rotate. Therefore, the thrust plates 364, 344 make relative orbiting motion and thereby slide relative to each other.

The compressor 10 includes a plurality of fastening bolts 70 for fastening the constituent components of the compression mechanism 30. The fastening bolts 70 securely fasten the main bearing member 36 and the stationary scroll 32 together to form the compression mechanism 30.

The fastening bolts 70 include a plurality of primary bolts 71 and a plurality of secondary bolts 72. The primary bolts 71 fasten only two components, i.e., the stationary scroll 32 and the main bearing member 36 together. The bearing fixing portion 362 has a plurality of female-threaded parts 365 which correspond to male-threaded parts 71*a*, respectively, of the primary bolts 71.

In a state where the bearing fixing portion 362 of the main bearing member 36 is clamped between the stepped portion 80 and the stationary scroll 32, the secondary bolts 72 fasten the above-described three components together. The stepped portion 80 has a plurality of female-threaded parts 84 which correspond to male-threaded parts 72*a*, respectively, of the secondary bolts 72.

The compression mechanism 30 is inserted into the first housing 121 through the opening 121*a* and is fixed to the first housing 121 in a state where the compression mechanism 30 abuts against the step surface 81 at the inside of the first housing 121.

The compressor 10 includes a main bearing aligning structure that coaxially aligns a central axis of the main bearing 361*a* and a central axis of the second inner circumferential surface 83 of the tubular portion 121*b* to which the compression mechanism 30 is inserted. The main bearing aligning structure includes a socket and spigot fitting structure (or simply referred to as a spigot fitting structure) 91 and a pin fitting structure 92.

The socket and spigot fitting structure 91 is a fitting structure, at which an outer peripheral surface (an outer periphery) 30*a* of the compression mechanism 30 is fitted to the second inner circumferential surface 83 of the tubular portion 121*b* to position the main bearing member 36 in place. The socket and spigot fitting structure 91 of this type can be formed with high precision by machining using general-purpose equipment, such as a lathe.

Specifically, the socket and spigot fitting structure 91 is the structure, at which the outer peripheral surface of the bearing fixing portion 362 of the main bearing member 36, which forms a very small clearance relative to the second inner circumferential surface 83, is installed to the second inner circumferential surface 83 of the first housing 121. The outer peripheral surface of the bearing fixing portion 362 is processed to be coaxial with the inner circumferential surface of the main bearing 361*a*, so that the main bearing member 36 can be highly accurately positioned at the inside of the first housing 121 by the socket and spigot fitting structure 91 described above.

The pin fitting structure 92 is a fitting structure, at which a common positioning pin 92*c* is fitted into each of a housing hole 92*a* formed at the first housing 121 and a main bearing side hole 92*b* formed at the main bearing member 36 to position the main bearing member 36 in place.

The positioning pin 92*c* is a cylindrical member. Each of the housing hole 92*a* and the main bearing side hole 92*b* is a blind hole that has a size which enables insertion of the positioning pin 92*c* therein. The housing hole 92*a* and the main bearing side hole 92*b* are respectively formed at a part of the first housing 121 and a part of the main bearing member 36 which are opposed to each other. Specifically, the housing hole 92*a* is formed at the step surface 81 of the first housing 121. The main bearing side hole 92*b* is formed at an end surface 362*b* of the bearing fixing portion 362 which contacts the step surface 81 of the first housing 121.

Here, it should be noted that there is a scroll compressor 10 that has a cantilever structure, at which a load of the drive shaft 14 is supported by the main bearing 361*a*. This type of cantilever structure tends to tilt the drive shaft 14 relatively to the bearing.

In contrast, in the compressor 10 of the present embodiment, the portion of the drive shaft 14, which is located on the other side in the axial direction DRa, is rotatably supported by the sub-bearing 16*a* of the sub-bearing member 16, so that the compressor 10 of the present embodiment has excellent reliability. Hereinafter, the sub-bearing member 16 will be described with reference to FIGS. 1 and 2.

The sub-bearing member 16 is formed separately from the first housing 121 and is fixed to a bottom surface of the bottom portion 121*c* of the first housing 121. Specifically, the sub-bearing member 16 is fixed to the bottom surface of the bottom portion 121*c* by a plurality of fastening bolts 18.

The sub-bearing member 16 includes: the body portion 161, which is shaped in the tubular form; a flange portion 162 which is connected to an end part of the body portion 161; and a projection 93*a*. The body portion 161, the flange portion 162 and the projection 93*a* are made of a steel material or aluminum alloy. The body portion 161, the flange portion 162 and the projection 93*a* are formed integrally in one-piece as an integrated article.

The body portion 161 forms the sub-bearing 16*a* at the inside of the body portion 161. The sub-bearing 16*a* is a sliding bearing. An inner circumferential surface of the sub-bearing 16*a* is processed in such a manner that a high degree of coaxiality of the inner circumferential surface of the sub-bearing 16*a* relative to an outer peripheral surface of the projection 93*a* is achieved. The sub-bearing 16*a* is fixed integrally to the sub-bearing member 16. Specifically, the sub-bearing 16*a* includes: a steel member shaped in a cylindrical tubular form; and a resin layer or the like which is coated to an inner circumferential surface of the steel member. Here, it should be noted that the sub-bearing 16*a* may be made of the same material as that of the body portion 161 and may be formed integrally in one-piece with the sub-bearing member 16.

The sub-bearing 16*a* can more effectively provide a tilt support when a distance of the sub-bearing 16*a* from the main bearing 361*a* is increased. In view of this point, at the time of placing the sub-bearing 16*a* away from the main bearing 361*a*, the electric motor unit 20 is interposed between the main bearing 361*a* and the sub-bearing 16*a*. In this way, the space at the inside of the housing 12 can be effectively utilized.

The flange portion 162 is a portion that is fixed to the bottom portion 121*c* of the first housing 121. The flange portion 162 is shaped in a circular ring form. The flange portion 162 outwardly extends in the radial direction of the drive shaft 14. The flange portion 162 has a plurality of insertion holes 162*a*, into which the fastening bolts 18 are respectively inserted. The number of the insertion holes 162*a* is three, and these insertion holes 162*a* are arranged at equal intervals in the circumferential direction of the flange portion 162. The number of the fastening bolts 18 is three, and the sub-bearing member 16 of the present embodiment is fixed to the bottom portion 121*c* by these three fastening bolts 18. The number of the fastening bolts 18 is not limited to three and can be any number that is equal to or larger than one.

Here, the compressor 10 includes a sub-bearing aligning structure that coaxially aligns a central axis of the sub-bearing 16*a* and the central axis of the second inner circumferential surface 83 of the tubular portion 121*b*. The sub-bearing aligning structure includes a socket and spigot fitting structure 93.

The socket and spigot fitting structure 93 is a fitting structure, at which a projection formed at one of the first housing 121 and the sub-bearing member 16 is fitted into a recess formed at another one of the first housing 121 and the sub-bearing member 16 to position the sub-bearing member 16 in place. Specifically, the socket and spigot fitting structure 93 is a fitting structure, at which the projection 93*a*, which is formed at the sub-bearing member 16, is fitted into a recessed hole 93*b*, which is formed at the first housing 121, to position the sub-bearing member 16 in place. The socket and spigot fitting structure 93 of this type can be formed with high precision by machining using the general-purpose equipment, such as the lathe. In the socket and spigot fitting structure 93 of the present embodiment, the projection 93*a* serves as the projection, and the recessed hole 93*b* serves as the recess.

Here, the recessed hole 93*b* is a cylindrical blind hole. The recessed hole 93*b* is formed at a central part of the bottom portion 121*c* such that the central axis of the recessed hole 93*b* is coaxial with the central axis of the second inner circumferential surface 83 of the first housing 121. The projection 93*a* is shaped in a cylindrical tubular form. The projection 93*a* has an outer peripheral surface that enables fitting of the projection 93*a* to the inside of the recessed hole 93*b*. The outer peripheral surface of the projection 93*a* is processed such that the outer peripheral surface of the projection 93*a* is coaxial with the inner circumferential surface of the sub-bearing 16*a*. Furthermore, an axial length of the projection 93*a* is set to be smaller than an axial length of the recessed hole 93*b* to limit contact of a distal end of the projection 93*a* to a bottom surface of the recessed hole 93*b* at the time of fitting the projection 93*a* into the recessed hole 93*b*.

The sub-bearing aligning structure of the present embodiment is the socket and spigot fitting structure, at which the outer peripheral surface of the projection 93*a*, which forms a very small clearance relative to the recessed hole 93*b*, is installed to the recessed hole 93*b*. The outer peripheral surface of the projection 93*a* is processed to be coaxial with the inner circumferential surface of the sub-bearing 16*a*, so that the sub-bearing member 16 can be highly accurately positioned at the inside of the first housing 121 by the socket and spigot fitting structure 93 described above.

The sub-bearing member 16 is configured to be fixed to the bottom portion 121*c* of the first housing 121 in the state where the stator 21 is fixed to the first inner circumferential surface 82 of the tubular portion 121*b*. Specifically, the sub-bearing member 16 is configured such that an outer diameter of the flange portion 162 is smaller than an inner diameter of the stator 21.

Figure 3:
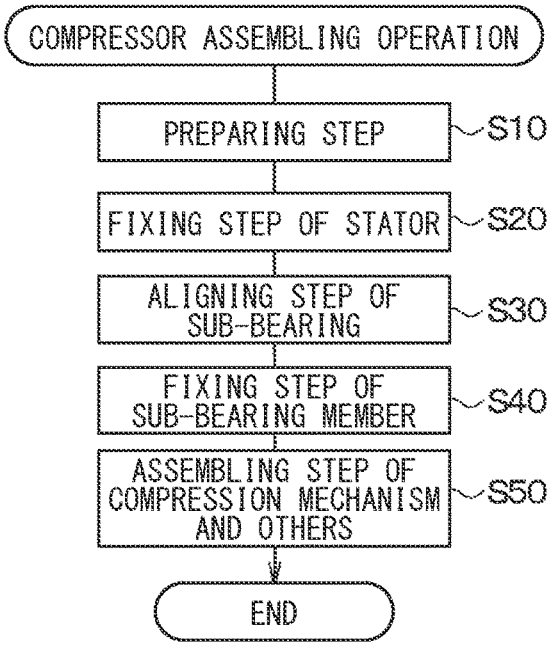
FIG. 3 is an explanatory diagram for explaining a flow of an assembling operation of constituent components of the compressor.

Next, a flow of an assembling operation of the constituent components of the compressor 10 will be described with reference to FIG. 3. As shown in FIG. 3, the assembling operation of the compressor 10 includes: a preparing step; a fixing step of the stator 21; an aligning step of the sub-bearing 16*a*, a fixing step of the sub-bearing member 16 and an assembling step of the compression mechanism 30 and the others.

In the assembling operation, first of all, at the preparing step at step S10, the constituent components of the compressor 10 are prepared. At this preparing step, there is prepared the first housing 121, which has the first inner circumferential surface 82 and the second inner circumferential surface 83 that are processed in such a manner that a high degree of coaxiality of the first inner circumferential surface 82 and the second inner circumferential surface 83 is achieved.

Next, at the fixing step of the stator 21 at step S20, the stator 21 of the electric motor unit 20 is fixed to the first inner circumferential surface 82 of the tubular portion 121*b*. In the present embodiment, the stator 21 is fixed to the first inner circumferential surface 82 of the first housing 121 by the thermal shrink fit.

Next, the aligning step of the sub-bearing 16*a* at step S30 is a step of coaxially aligning the central axis of the sub-bearing 16*a* and the central axis of the second inner circumferential surface 83 of the tubular portion 121*b*. In this aligning step, the projection 93*a* of the sub-bearing member 16 is fitted into the recessed hole 93*b* of the bottom portion 121*c* of the first housing 121. At the sub-bearing member 16, an outer circumferential surface of the projection 93*a* and the inner circumferential surface of the sub-bearing 16*a* are processed in such a manner that a high degree of coaxiality of the outer peripheral surface of the projection 93*a* and the inner circumferential surface of the sub-bearing 16*a* is achieved. Furthermore, the second inner circumferential surface 83 of the tubular portion 121*b* and the recessed hole 93*b* are processed in such a manner that a high degree of coaxiality of the second inner circumferential surface 83 of the tubular portion 121*b* and the recessed hole 93*b* is achieved. Furthermore, a very small clearance is formed between the outer peripheral surface of the projection 93*a* and the inner circumferential surface of the recessed hole 93*b*. Therefore, when the projection 93*a* is fitted into the recessed hole 93*b*, a misalignment of the central axis of the inner circumferential surface of the sub-bearing 16*a* relative to the central axis of the second inner circumferential surface 83 of the tubular portion 121*b* is limited.

Next, the fixing step of the sub-bearing 16*a* at step S40 is a step of fixing the sub-bearing member 16 to the inner surface of the bottom portion 121*c* of the first housing 121 in a state where the central axis of the sub-bearing 16*a* and the central axis of the second inner circumferential surface 83 of the tubular portion 121*b* are coaxially aligned. In this fixing step, the sub-bearing member 16 is fixed to the bottom portion 121*c* of the first housing 121 by the fastening bolts 18.

Next, at the assembling step of the compression mechanism 30 and the others at step S50, the main bearing member 36 and the stationary scroll 32 are temporarily assembled by the primary bolts 71 in a state where the drive shaft 14, the main bearing member 36, the orbiting scroll 34 and the stationary scroll 32 are assembled together. In this state, by coaxially aligning the main bearing member 36 and the stationary scroll 32, a deviation between the central axis of the orbiting scroll 34 and the central axis of the stationary scroll 32 is adjusted.

Thereafter, the compression mechanism 30 is assembled to the first housing 121. During the assembling of the compression mechanism 30 to the first housing 121, the compression mechanism 30 is inserted into the inside of the first housing 121 from the one side in the axial direction DRa. Then, the end surface 362*b* of the main bearing member 36 of the compression mechanism 30 is placed in contact with the step surface 81 of the first housing 121. In this state, the secondary bolts 72 are inserted from the one side toward the other side in the axial direction DRa.

Next, the compression mechanism 30 is securely fastened to the housing 12 by the secondary bolts 72. Then, after the assembling of the compression mechanism 30 to the first housing 121, the second housing 122 is fixed to the first housing 121. Furthermore, the inverter 25 is fixed to the outer surface of the bottom portion 121*c* of the first housing 121 before or after the fixing of the second housing 122 to the first housing 121. The rotor 22 of the electric motor unit 20 is fixed to the drive shaft 14 in advance by, for example, thermal shrink fit before the assembling of the compression mechanism 30 to the first housing 121.

The compressor 10 described above is applied to the refrigeration cycle device where the refrigerant, which includes the carbon dioxide as its main component, circulates. In this type of refrigeration cycle device, a difference between the high pressure and the low pressure is larger than that of a case where the fluorocarbon refrigerant is used. For this reason, a high load acts on, for example, the main bearing 361*a* and the sub-bearing 16*a* of the compressor 10, so that a required level of durability for the compressor 10 is high.

Therefore, in the compressor 10 of the present embodiment, the sliding bearing, which has the excellent durability, is used as the eccentric bearing 342*a*, the main bearing 361*a* and the sub-bearing 16*a*. As a result, even in the case where the difference between high pressure and low pressure in the cycle is large, and the high load acts on the bearings, the reliability against wear and degradation is improved, and the service life can be extended in comparison to a rolling bearing.

Furthermore, in a case where the sliding bearing is used as the main bearing 361*a* and the sub-bearing 16*a*, it is necessary to coaxially align the central axis of the main bearing 361*a* and the central axis of the sub-bearing 16*a* as much as possible from the viewpoint of improving the seizure resistance by limiting a rise of a localized contact pressure, and also the viewpoint of ensuring the wear resistance by good oil film formation.

Figure 4:
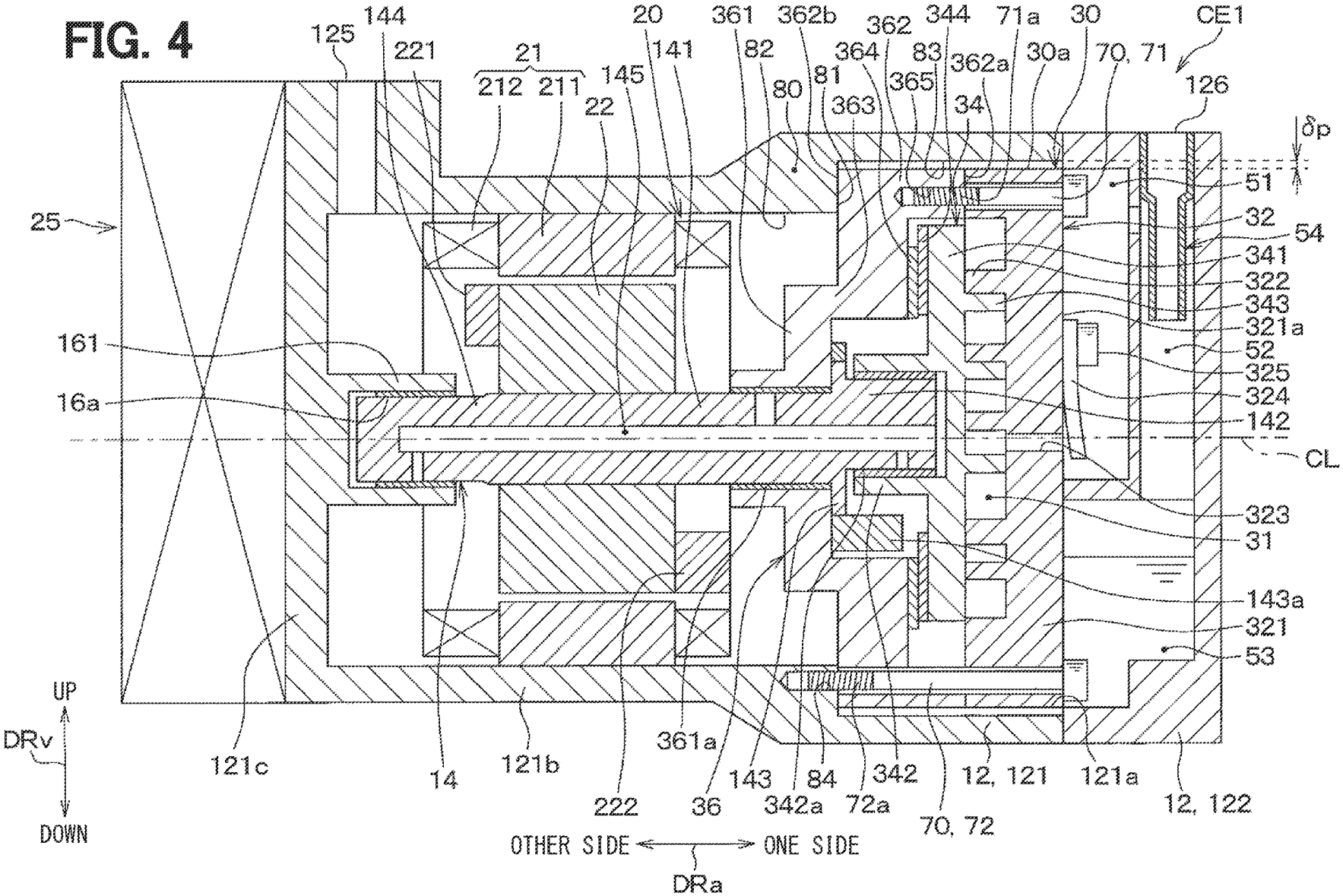
FIG. 4 is a schematic cross-sectional view of a compressor of a first comparative example of the first embodiment.

FIG. 4 is an axial cross-sectional view of a compressor CE1 of a first comparative example of the present embodiment. The compressor CE1 differs from the compressor 10 of the present embodiment in that the sub-bearing member 16 is integrally formed in one-piece with the bottom portion 121*c*, and that an alignment gap δp for enabling coaxial alignment of the central axes is formed between the outer peripheral surface 30*a* of the compression mechanism 30 and the second inner circumferential surface 83 of the tubular portion 121*b*. For convenience, in FIG. 4, among the components of the compressor CE1 of the first comparative example, those corresponding to the components of the compressor 10 of the present embodiment are given the same reference signs as the components of the compressor 10 of the present embodiment.

In the compressor CE1 of the comparative example shown in FIG. 4, the sub-bearing member 16 is integrally formed in one-piece with the bottom portion 121*c*, and thereby the position of the sub-bearing 16*a* cannot be adjusted relative to the first housing 121. Therefore, it is necessitated that assembling equipment is used to detect the central axis of the main bearing 361*a* while displacing the compression mechanism 30 relative to the first housing 121, and then coaxially align the central axis of the main bearing 361*a* with the central axis of the sub-bearing 16*a*, and thereafter tighten the secondary bolts 72 while maintaining the aligned state of the central axis of the main bearing 361*a* and the central axis of the sub-bearing 16*a*.

However, the above operation requires repetitions of the accurate detection of the amount of displacement of the central axis of the main bearing 361*a* while displacing the compression mechanism 30. Therefore, the above operation requires high equipment cost and long cycle time and is not suitable for mass-produced products, such as on-vehicle compressors.

Figure 5:
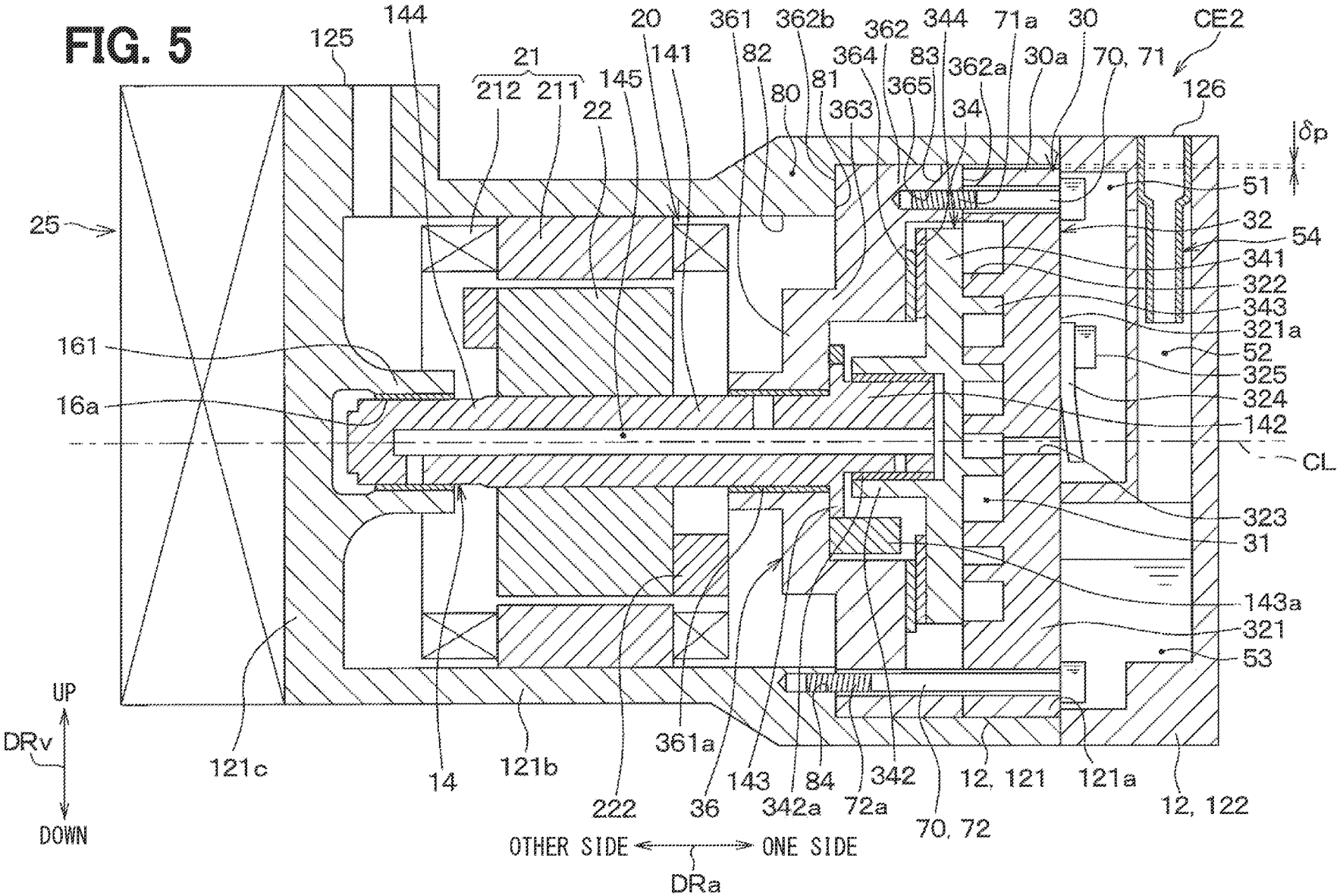
FIG. 5 is a schematic cross-sectional view of a compressor of a second comparative example of the first embodiment.

In view of the above point, as in a compressor CE2 of a second comparative example shown in FIG. 5, it is conceivable that the alignment gap δp of the compressor CE1 of the first comparative example is made extremely small, and it is also conceivable that the dimensional and shape tolerances, which have an influence on the variations in the relative coaxiality of the main bearing 361*a* and the sub-bearing 16*a*, are made highly accurate. In the compressor CE2 of the second comparative example, by simply assembling the constituent components, variations in the coaxiality of the bearings 361*a*, 16*a* can be contained within the acceptable range in terms of the quality.

In order to generate an oil film effectively in the sliding bearing, it is necessary to make the inner circumferential surface of the sliding bearing smooth and highly accurate. For this reason, in general, polishing of the inner circumferential surface of the sliding bearing is performed.

However, if the sub-bearing member 16 is formed integrally in one-piece with the bottom portion 121*c* as in the compressor CE2 of the second comparative example, it is necessary to increase a length of a shaft of a grindstone in order to polish the sub-bearing 16*a*.

When the length of the shaft of the grindstone is increased, deflection of the shaft or whirl of the grindstone causes an increase in a difficulty of polishing, and it becomes difficult to obtain the required precision of, for example, the coaxiality, the surface roughness and/or the cylindricity. In order to ensure the required precision, it is necessary to install specialized equipment that enables high-precision machining, and the investment becomes expensive.

In view of the above point, in the compressor 10 of the present embodiment, the sub-bearing member 16 is formed separately from the first housing 121 and is fixed to the bottom surface of the bottom portion 121*c* of the first housing 121. According to this configuration, since the inner circumferential surface of the sub-bearing 16*a* can be processed in the state where the sub-bearing member 16 is removed from the housing 12, the inner circumferential surface of the sub-bearing 16*a* can be processed with high precision without introducing dedicated equipment. That is, since the polishing of the sub-bearing 16*a* can be performed in the unassembled state of the sub-bearing member 16, it is not necessary to increase the length of the shaft of the grindstone, and the high polishing precision of the sub-bearing 16*a* can be ensured even with the relatively inexpensive general purpose equipment.

Therefore, in the compressor 10, which includes the first housing 121 shaped in the bottomed tubular form, the precision of the sub-bearing 16*a*, which supports the drive shaft 14 at the bottom portion 121*c* of the first housing 121, can be ensured without introducing the dedicated equipment. As a result, it is possible to achieve both the productivity and the high quality while limiting the capital investment.

This type of compressor 10 is effective for applications with the high durability requirements, such as the refrigeration cycle device where the refrigerant, which includes the carbon dioxide as its main component, is used, and the difference between high pressure and the low pressure in the cycle is large. In addition, the compressor 10 of the present embodiment can be effectively applied as a compressor, such as the on-vehicle compressor that has high needs for compactness, lightweight and low-cost. Furthermore, the compressor 10 of the present embodiment can be effectively applied as a compressor, such as a scroll compressor, which has the following structure. That is, the cantilever structure is used to support the load of the drive shaft 14, and the relative tilt between the drive shaft 14 and the bearing tends to occur, and the localized contact pressure increase of the bearing is likely to occur.

Specifically, the sub-bearing member 16 is fixed to the bottom surface of the bottom portion 121*c* by the fastening bolts 18. According to this fastening method, the high fastening force can be obtained with the relatively small number of the assembling steps.

Particularly, the compressor 10 includes the sub-bearing aligning structure that coaxially aligns the central axis of the sub-bearing 16*a* and the central axis of the second inner circumferential surface 83 of the tubular portion 121*b*. With this structure, a misalignment between the central axis of the sub-bearing 16*a* and the central axis of the second inner circumferential surface 83 of the first housing 121 can be limited.

In addition, the compressor 10 includes the main bearing aligning structure that coaxially aligns the central axis of the main bearing 361*a* and the central axis of the second inner circumferential surface 83 of the tubular portion 121*b*. With this structure, a misalignment between the central axis of the main bearing 361*a* and the central axis of the second inner circumferential surface 83 of the first housing 121 can be limited.

Since the compressor 10 has both the main bearing aligning structure and the sub-bearing aligning structure, a misalignment of the central axis of the inner circumferential surface of the main bearing 361*a* and the central axis of the inner circumferential surface of the sub-bearing 16*a* caused by accumulation of the tolerances at the time of the assembling operation can be highly accurately limited. As a result, the seizure resistance can be improved by limiting the localized contact pressure increase of the respective bearings 361*a*, 16*a*. In addition, each bearing 361*a*, 16*a* can have a good state of the oil film formation, and thereby the wear resistance can be improved. Thus, the reliability of each bearing 361*a*, 16*a* can be improved.

Specifically, the sub-bearing aligning structure includes the socket and spigot fitting structure 93, at which the projection 93*a*, which is formed at the sub-bearing member 16, is fitted into the recessed hole 93*b*, which is formed at the first housing 121, to position the sub-bearing member 16 in place. The recessed hole 93*b* and the projection 93*a* of the socket and spigot fitting structure 93 can be formed with high precision by machining using the general-purpose equipment, such as the lathe. Therefore, the positioning precision of the sub-bearing member 16 can be ensured without introducing the dedicated equipment.

The main bearing aligning structure includes the socket and spigot fitting structure 91, at which the outer periphery of the compression mechanism 30 is fitted to the second inner circumferential surface 83 of the first housing 121 to position the main bearing member 36 in place. The socket and spigot fitting structure 91 of this type can be formed with high precision by machining using the general-purpose equipment, such as the lathe. Therefore, the positioning precision of the main bearing member 36 can be ensured without introducing the dedicated equipment.

The main bearing aligning structure includes the pin fitting structure 92, at which the common positioning pin 92*c* is fitted into each of the housing hole 92*a* formed at the first housing 121 and the main bearing side hole 92*b* formed at the main bearing member 36 to position the main bearing member 36 in place.

With this structure, the misalignment of the central axis of the main bearing 361*a* relative to the central axis of the second inner circumferential surface 83 of the first housing 121 can be limited, and the main bearing member 36 can be positioned in place in the rotational direction by the positioning pin 92*c*. Therefore, the assemblability of the main bearing member 36 to the first housing 121 can be ensured. In addition, even when the drive force of the electric motor unit 20 is applied to the compression mechanism 30, which includes the main bearing member 36, the positioning pin 92*c* functions as a rotation stopper to limit dragged rotation of the main bearing member 36 caused by the drive force of the electric motor unit 20.

Here, in a case where the tubular portion 121*b* and the bottom portion 121*c* of the first housing 121 are formed separately unlike the present embodiment, it is necessary to provide a required wall thickness to each of the tubular portion 121*b* and the bottom portion 121*c* to form bolt seats for fastening the tubular portion 121*b* and the bottom portion 121*c* together by bolts.

In contrast, in the compressor 10 of the present embodiment, the first housing 121 is the seamless integral article where the tubular portion 121*b* and the bottom portion 121*c* are integrally formed in one-piece. According to this structure, it is not necessary to provide the additional thickness to each of the tubular portion 121*b* and the bottom portion 121*c* to form the bolt seat, and thereby the required rigidity of each of the tubular portion 121*b* and the bottom portion 121*c* can be obtained with the relatively thin wall thickness of each of the tubular portion 121*b* and the bottom portion 121*c*. This structure reduces the number of the components and ensures the pressure resistance while reducing the weight of the housing 12.

Modifications of First Embodiment

In the first embodiment described above, the constituent components and the various structures of the compressor 10 are explained specifically. However, the compressor 10 of the present disclosure is not limited to the above-described compressor 10, and the above-described compressor 10 may be modified, for example, as follows. It should be noted that the following modifications are not limited to the first embodiment and are equally applicable to the other embodiments.

In the first embodiment, there is described the compressor 10 that includes the socket and spigot fitting structure 91 and the pin fitting structure 92 as the main bearing aligning structure. However, the compressor 10 of the present disclosure is not limited to this. The compressor 10 may include, for example, only one of the socket and spigot fitting structure 91 and the pin fitting structure 92. Furthermore, in the compressor 10, an alignment gap δp for enabling coaxial alignment of the central axes may be formed between the outer peripheral surface 30*a* of the compression mechanism 30 and the second inner circumferential surface 83 of the first housing 121 in place of the main bearing aligning structure.

In the first embodiment described above, as the socket and spigot fitting structure 93, there is exemplified the structure, at which the projection formed at the sub-bearing member 16 is fitted into the recess formed at the bottom portion 121*c* of the first housing 121. However, the socket and spigot fitting structure 93 is not limited to this structure. The socket and spigot fitting structure 93 may be, for example, a fitting structure, at which a projection formed at the bottom portion 121*c* of the first housing 121 is fitted into a recess formed at the sub-bearing member 16. Furthermore, the socket and spigot fitting structure 93 may be a fitting structure, at which a projection, which has a shape other than the circular shape, and a recess, which has a shape corresponding to the shape of the projection, are fitted together while a clearance between the projection and the recess is substantially eliminated.

Figure 6:
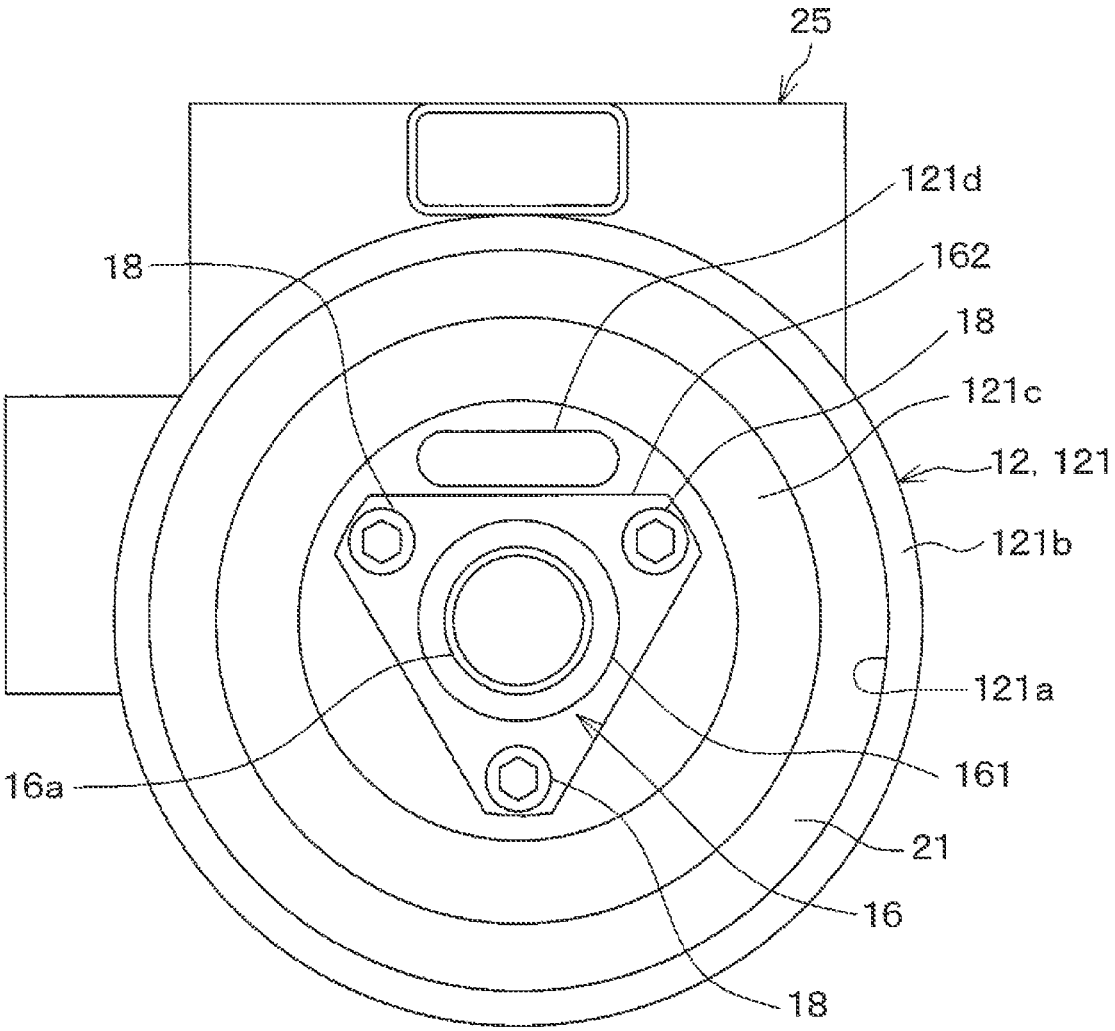
FIG. 6 is a schematic view showing a bottom surface of a first housing and a sub-bearing member of a compressor of a modification of the first embodiment.

In the first embodiment described above, there is described the example, in which the sub-bearing member 16 includes the flange portion 162 shaped in the circular form. However, the shape of the flange portion 162 is not limited to this shape, and the flange portion 162 may have a shape that is other than the circular form. For example, the flange portion 162 may have an approximately triangular form, as shown in FIG. 6. According to this structure, a covered area, which is covered by the flange portion 162 at the bottom surface of the bottom portion 121*c* of the first housing 121, can be reduced. As a result, interference between the flange portion 162 and the airtight terminals 121*d* can be easily avoided, and thereby a degree of freedom in the layout of the airtight terminals 121*d* can be improved.

In the compressor 10 described in the above first embodiment, the compression mechanism 30 is fixed to the first housing 121 by the secondary bolts 72. If the compression mechanism 30 can be fixed to the first housing 121 by other means, such as clamping of the compression mechanism 30 between the first housing 121 and the second housing 122, the secondary bolts 72 may be eliminated. Even if the compression mechanism 30 is not fixed, the secondary bolts 72 are not necessarily required. That is, if the compression mechanism 30 is pressed against the step surface 81 between the inner circumferential surfaces 82, 83 of the first housing 121 by a pressure difference generated during the operation of the compressor 10 and is substantially fixed in place during the operation by a frictional force generated by the pressure difference, the secondary bolts 72 are not required. In this case, even when the rotational force is applied from the electric motor unit 20 to the compression mechanism 30, the rotational force is received by the positioning pin 92*c* of the pin fitting structure 92, and thereby it is possible to limit the positional deviation, such as dragged rotation, of the compression mechanism 30.

Second Embodiment

Figure 7:
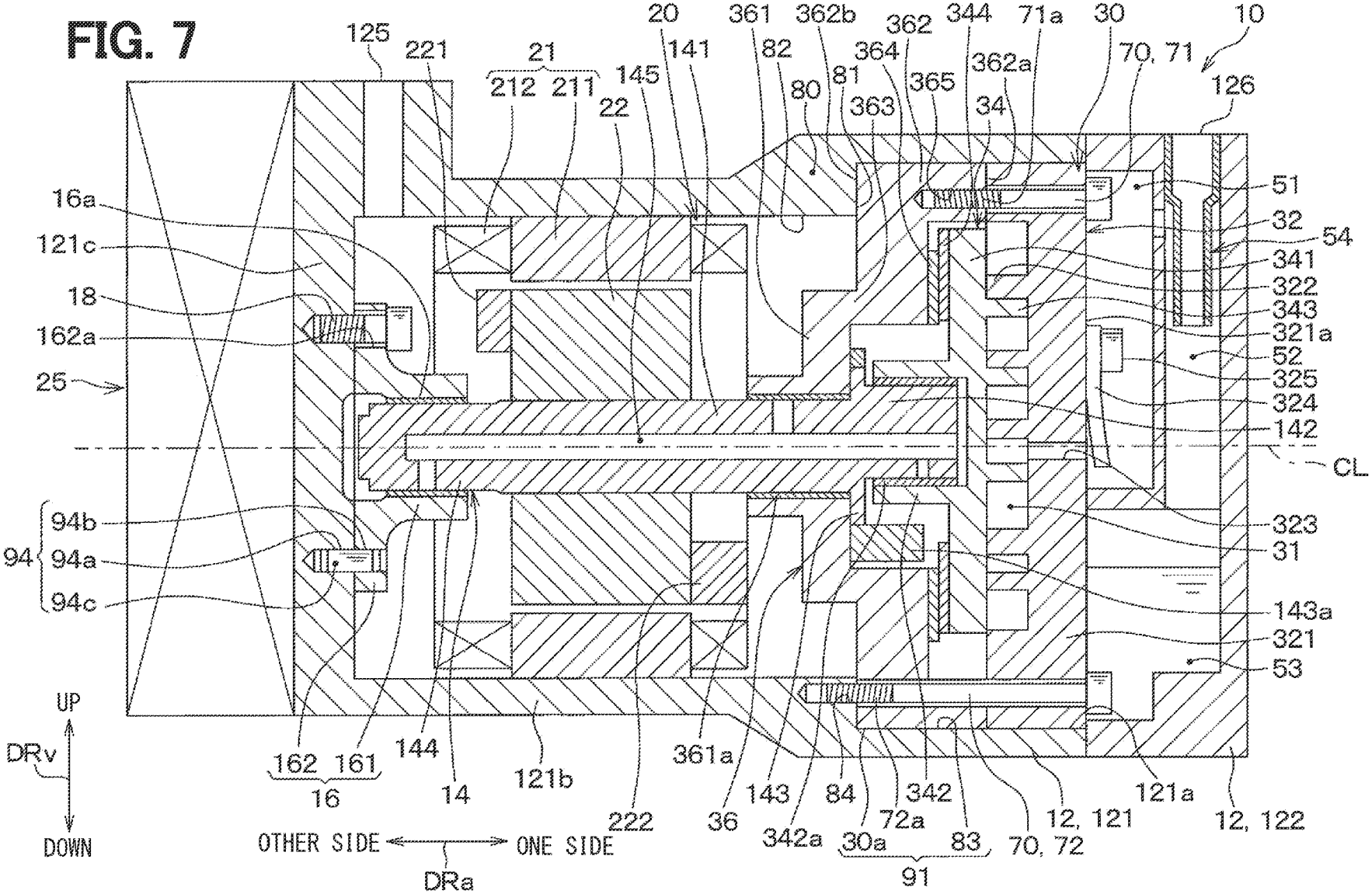
FIG. 7 is a schematic cross-sectional view of a compressor according to a second embodiment.

Next, a second embodiment will be described with reference to FIG. 7. In the present embodiment, points, which are different from the first embodiment, will be mainly described.

In the compressor 10 of the present embodiment, the pin fitting structure 92 described in the first embodiment is eliminated. Furthermore, in place of the socket and spigot fitting structure 93 described in the first embodiment, the sub-bearing aligning structure is formed by a pin fitting structure 94. The pin fitting structure 94 is a fitting structure, at which a common positioning pin 94*c* is fitted into each of a bottom wall hole 94*a* formed at the bottom portion 121*c* of the first housing 121 and a sub-bearing side hole 94*b* formed at the sub-bearing member 16 to position the sub-bearing member 16 in place.

The positioning pin 94*c* is a cylindrical member. The bottom wall hole 94*a* is a blind hole that has a size which enables insertion of the positioning pin 94*c* therein. The sub-bearing side hole 94*b* is a blind hole or a through-hole that has a size which enables insertion of the positioning pin 94*c* therein. The bottom wall hole 94*a* and the sub-bearing side hole 94*b* are respectively formed at a part of the bottom portion 121*c* and a part of the sub-bearing member 16 which are opposed to each other. Specifically, a plurality of bottom wall holes 94*a* are formed at the portion of the bottom surface of the bottom portion 121*c* which is opposed to the flange portion 162. A plurality of sub-bearing side holes 94*b* are formed at a portion of the flange portion 162 which contacts the bottom surface of the bottom portion 121*c*. A corresponding one of a plurality of positioning pins 94*c* is inserted in a corresponding one of the bottom wall holes 94*a* and a corresponding one of the sub-bearing side holes 94*b* to position the sub-bearing member 16 in place. The fitting between the bottom wall hole 94*a* and the positioning pin 94*c* and the fitting between the sub-bearing side hole 94*b* and the positioning pin 94*c* may be such that only one or both of these two fittings may be press-fitting. In this case, the positioning pin 94*c* is fixed by the press-fitting, and there is no possibility of unintentional removal of the positioning pin 94*c*. Therefore, the sub-bearing side hole 94*b* may be a through-hole.

The rest of the structure and the operation are the same as those of the first embodiment. In the compressor 10 of the present embodiment, the sub-bearing aligning structure includes the pin fitting structure 94. With this structure, the misalignment of the central axis of the sub-bearing 16*a* relative to the central axis of the second inner circumferential surface 83 of the first housing 121 can be limited, and the sub-bearing member 16 can be positioned in place in the rotational direction by the positioning pin 94*c*. As a result, the alignment between the insertion hole 162*a* of the sub-bearing member 16 for the fastening bolt 18 and a threaded hole formed at the bottom portion 121*c* becomes easy, so that the assemblability of the sub-bearing member 16 to the first housing 121 can be sufficiently ensured.

Modifications of Second Embodiment

In the second embodiment described above, there is described the example, in which the sub-bearing aligning structure is formed by the pin fitting structure 94. However, the sub-bearing aligning structure is not limited to this structure. For example, the sub-bearing aligning structure may include both of the socket and spigot fitting structure 93 and the pin fitting structure 94.

Third Embodiment

Next, a third embodiment will be described with reference to FIGS. 8 to 10. In the present embodiment, points, which are different from the second embodiment, will be mainly described.

Figure 8:
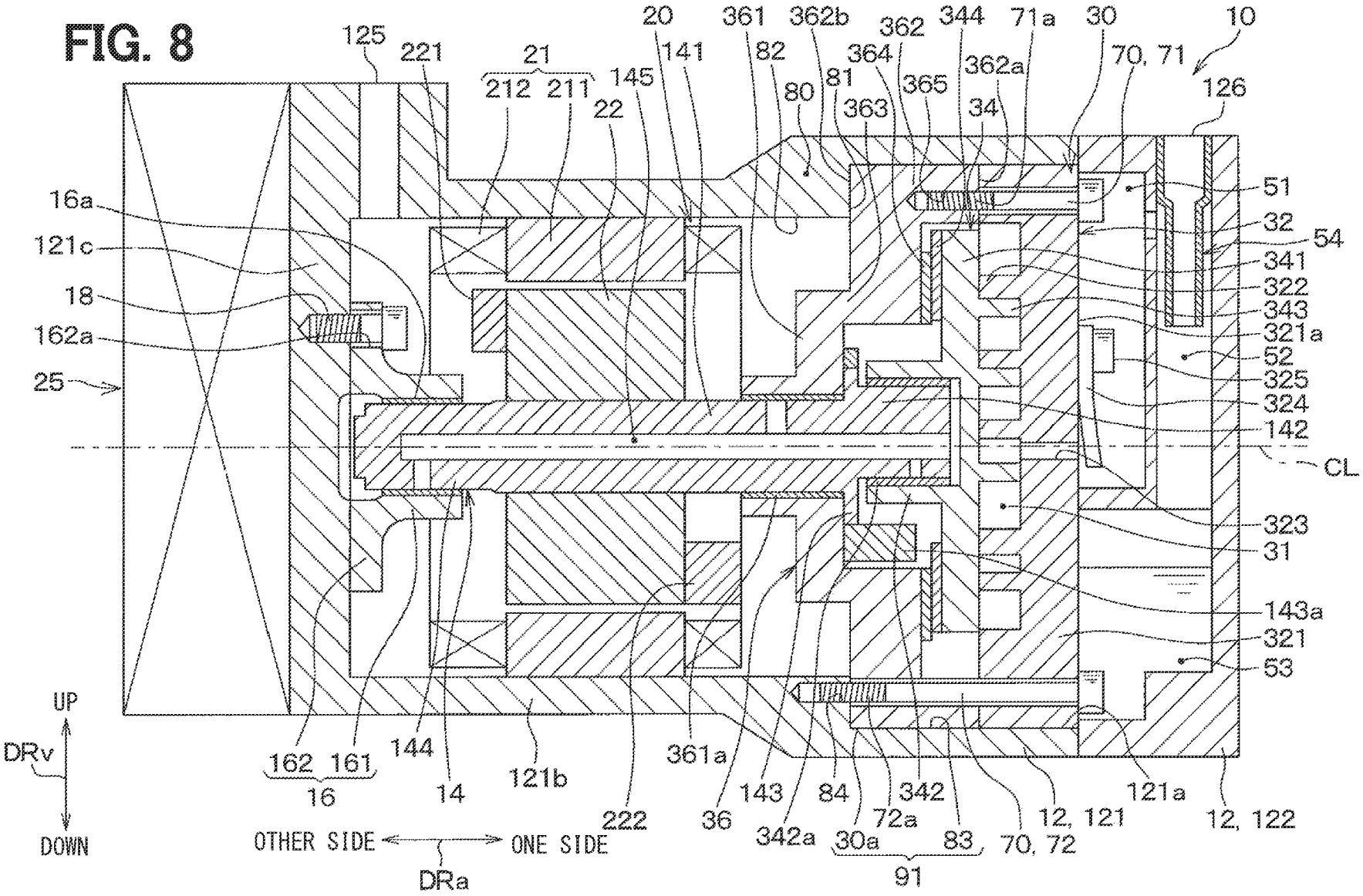
FIG. 8 is a schematic cross-sectional view of a compressor according to a third embodiment.

As shown in FIG. 8, the compressor 10 of the present embodiment does not have the sub-bearing aligning structure. Specifically, the first housing 121 and the sub-bearing member 16 do not have the structures which correspond to the socket and spigot fitting structure 93 described in the first embodiment and the pin fitting structure 94 described in the second embodiment.

Figure 9:
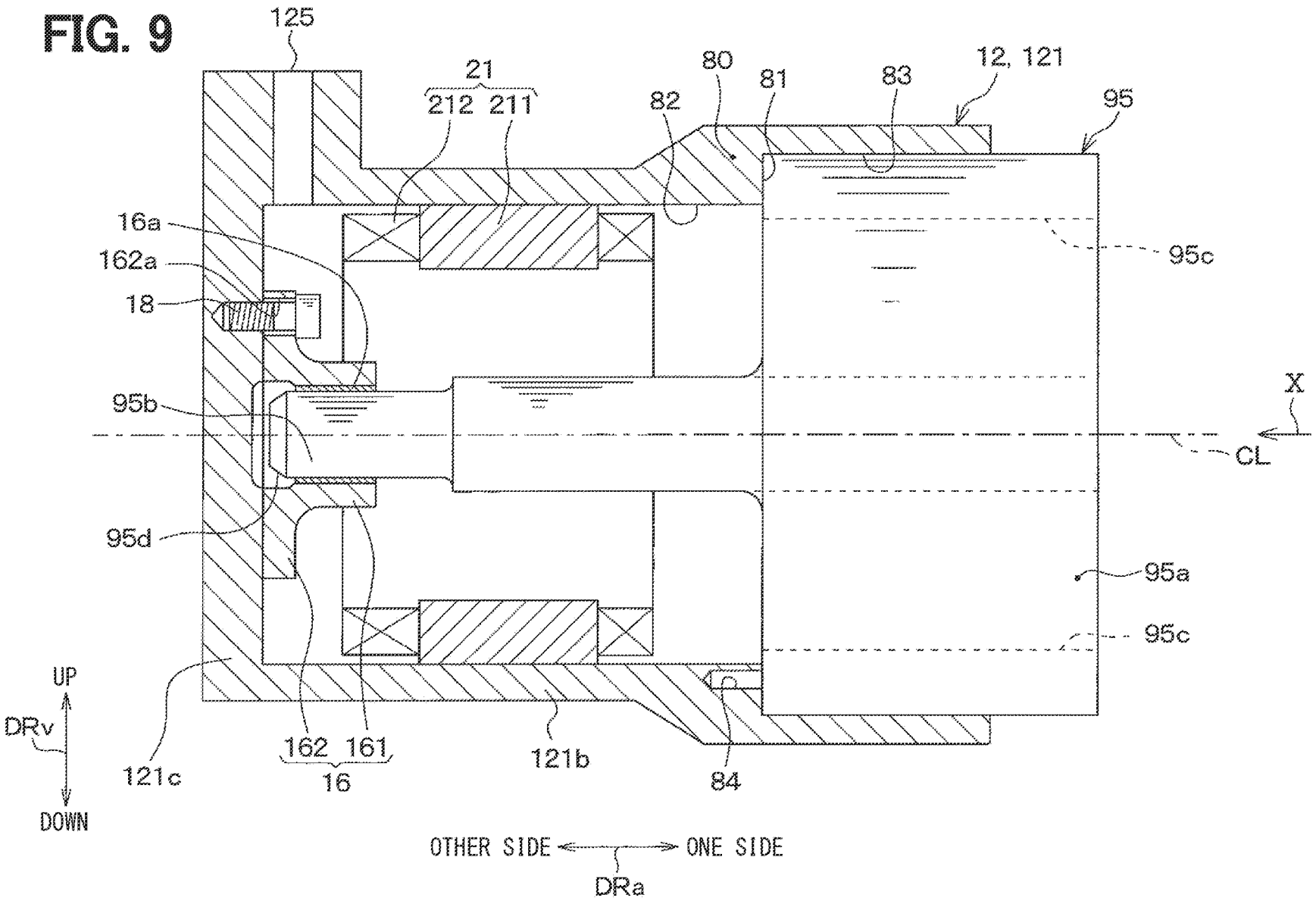
FIG. 9 is a schematic cross-sectional view showing a state where an aligning jig is inserted into an inside of a first housing of the compressor.
Figure 10:
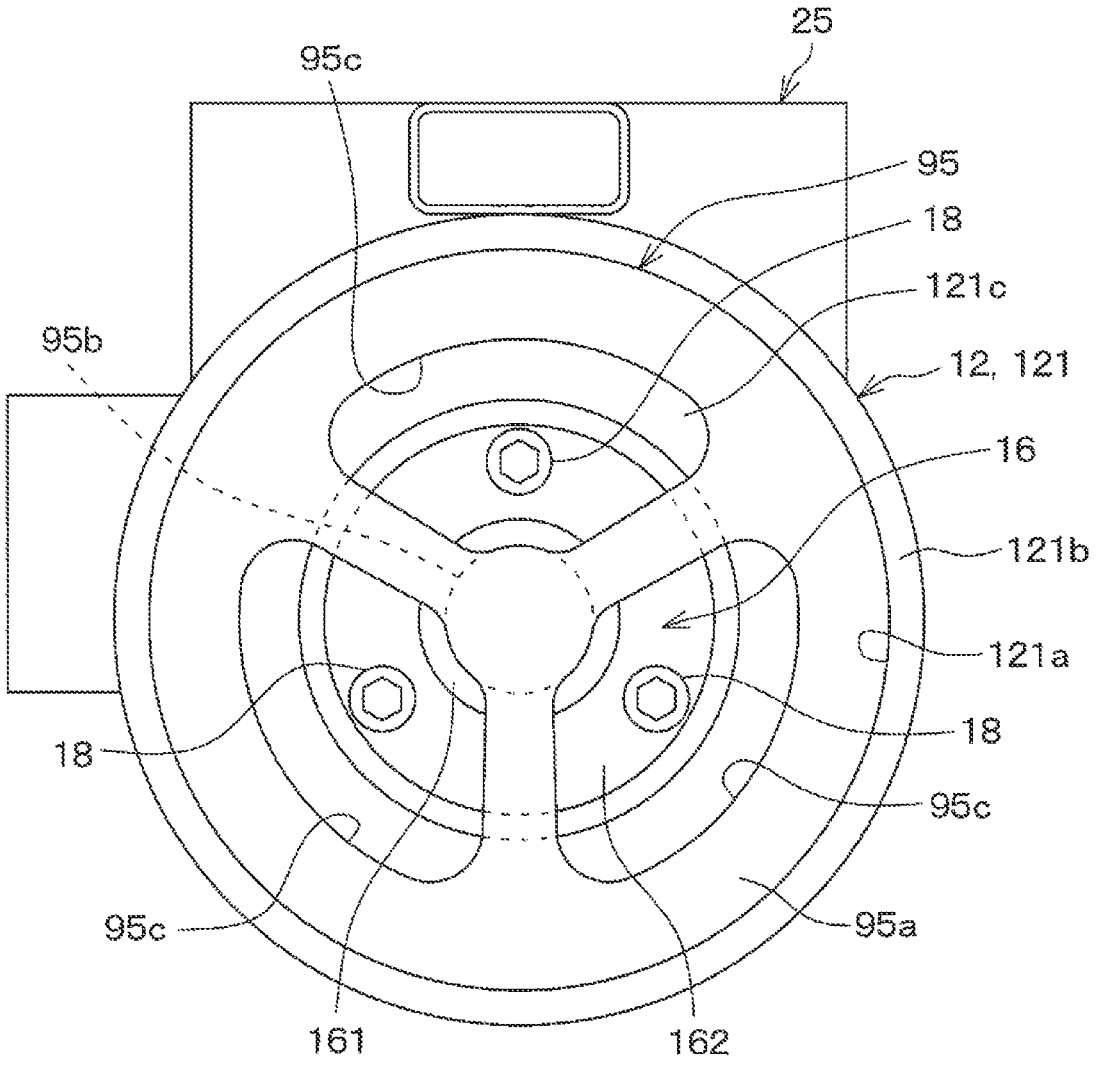
FIG. 10 is a view taken in a direction of an arrow X in FIG. 9.

In place of these structures, in the compressor 10, in a state where the central axis of the sub-bearing 16*a* and the central axis of the second inner circumferential surface 83 of the tubular portion 121*b* are coaxially aligned by an aligning jig 95 shown in FIGS. 9 and 10, the sub-bearing member 16 is fixed to the bottom surface of the bottom portion 121*c* of the first housing 121.

The aligning jig 95 is a dummy shaft that mimics the drive shaft 14. The aligning jig 95 can be fitted to both of the inner circumferential surface of the sub-bearing 16*a* and the second inner circumferential surface 83 of the first housing 121.

The aligning jig 95 has: a large diameter portion 95*a* which has an outer diameter that can be fitted to the second inner circumferential surface 83 of the tubular portion 121*b*; and a small diameter portion 95*b* which has an outer diameter that can be fitted to the inner circumferential surface of the sub-bearing 16*a*. The aligning jig 95 is processed such that a central axis of the large diameter portion 95*a* and a central axis of the small diameter portion 95*b* coincide with each other at extremely high precision. The outer diameter of the small diameter portion 95*b* is smaller than the outer diameter of the large diameter portion 95*a*.

The large diameter portion 95*a* has an approximately cylindrical shape and is processed to such a size that the outer diameter of the large diameter portion 95*a* forms an extremely small clearance relative to the inner diameter of the second inner circumferential surface 83 of the tubular portion 121*b*. As shown in FIG. 10, the large diameter portion 95*a* has a plurality of through-holes 95*c* which extend through the large diameter portion 95*a* in the axial direction DRa. Each of these through-holes 95*c* is formed to enable insertion of a bolt fastening jig, which is configured to fasten a corresponding one of the fastening bolts 18, into the through-hole 95*c*. Each of the through-holes 95*c* is formed at a corresponding location of the large diameter portion 95*a* which is opposed to a corresponding one of the insertion holes 162*a* of the flange portion 162.

The small diameter portion 95*b* has an approximately cylindrical shape and is processed such that the outer diameter of the small diameter portion 95*b* forms an extremely small clearance relative to the inner diameter of the sub-bearing 16*a*. The small diameter portion 95*b* has a tapered portion 95*d* for a guiding purpose at a distal end part of the small diameter portion 95*b*, which is opposite to a connecting portion that connects between the large diameter portion 95*a* and the small diameter portion 95*b*. The tapered portion 95*d* eases insertion of the small diameter portion 95*b* into the inside of the sub-bearing 16*a*.

Next, an assembling operation of the constituent components of the compressor 10 of the present embodiment will be described. Among the assembling operation of the compressor 10, those common to the first embodiment will be simplified or omitted from the explanation.

In the assembling operation of the compressor 10 of the present embodiment, first of all, at the preparing step, the constituent components of the compressor 10 are prepared. Next, at the fixing step of the stator 21 at step S20, the stator 21 of the electric motor unit 20 is fixed to the first inner circumferential surface 82 of the tubular portion 121*b* by the thermal shrink fit.

Next, at the aligning step of the sub-bearing 16*a* at step S30, first of all, the sub-bearing member 16 is temporarily fixed to the bottom surface of the bottom portion 121*c* by the fastening bolts 18. In this state, the fastening bolts 18 are not tightened with a prescribed torque, and a position of the sub-bearing member 16 can be shifted.

Thereafter, at the aligning step, the aligning jig 95 is fitted into the inside of the first housing 121. Specifically, at the aligning step, the large diameter portion 95*a* of the aligning jig 95 is fitted to the second inner circumferential surface 83 of the tubular portion 121*b*, and the small diameter portion 95*b* of the aligning jig 95 is fitted to the inner circumferential surface of the sub-bearing 16*a*. At this time, there is established a state where the misalignment between the central axis of the second inner circumferential surface 83 of the tubular portion 121*b* and the central axis of the inner circumferential surface of the sub-bearing 16*a* is limited.

Next, at the fixing step of the sub-bearing 16*a* at step S40, the fastening bolts 18 are fastened with the prescribed torque to fix the sub-bearing member 16 to the bottom surface of the bottom portion 121*c*. At this step, for each of the fastening bolts 18, the bolt fastening jig is inserted through the through-hole 95*c* formed through the large diameter portion 95*a*, and the fastening bolt 18 is fastened with the prescribed torque by the bolt fastening jig.

Next, at the assembling step of the compression mechanism 30 and the other components at step S50, the aligning jig 95 is removed from the inside of the first housing 121. Thereafter, the assembling of the drive shaft 14 to the sub-bearing 16*a* and the assembling of the compression mechanism 30 to the first housing 121 are performed.

According to the assembling operation described above, even in the case where the compressor 10 does not have the sub-bearing aligning structure, the positioning precision of the sub-bearing member 16 can be ensured by the aligning jig 95. According to this, the relative misalignment between the central axis of the main bearing 361*a* and the central axis of the sub-bearing 16*a* can be limited with high precision while limiting the product cost.

Here, at the fixing step of the stator 21, the first housing 121 is heated to the high temperature to place the first housing 121 in a state of being thermally expanded. Then, the stator 21 is inserted into the heated first housing 121. Thereafter, the first housing 121 is shrunk to the initial state at the time of cooling the first housing 121 to a normal temperature, so that the stator 21 is fixed to the first housing 121.

In general, in order to limit the loosening of the stator 21 relative to the first housing 121 under the temperature distribution environment in each operating condition of the compressor 10, it is necessary to increase the tightening margin at the time of executing the thermal shrink fit. However, if the tightening margin is large, the strain of the first housing 121 becomes large. In addition, for example, in the case where the material of the first housing 121 is aluminum alloy or the like, the first housing 121 is likely to be strained due to stress relaxation or the like caused by the high temperature of the first housing 121 at the time of executing the thermal shrink fit. These strains of the first housing 121 will likely cause the misalignment of the central axis of the sub-bearing 16*a*.

In contrast, in the compressor 10 of the present embodiment, the coaxial alignment of the central axis of the sub-bearing 16*a* by the aligning jig 95 is performed after the fixing step of the stator 21. Therefore, the sub-bearing member 16 can be fixed to the bottom surface of the bottom portion 121*c* in the state where the misalignment of the central axis caused by the strains of the first housing 121 is canceled by the aligning jig 95. Specifically, according to the assembling operation of the present embodiment, it is possible to limit the misalignment of the axes with higher precision.

Modifications of Third Embodiment

In the above embodiment, the specific shape and structure of the aligning jig 95 are described. However, the aligning jig 95 of the present disclosure is not limited to this. The aligning jig 95 may be different from that of the third embodiment as long as it is possible to coaxially align the central axis of the inner circumferential surface of the sub-bearing 16*a* and the central axis of the second inner circumferential surface 83 of the tubular portion 121*b*. In addition, the aligning jig 95 may be formed as a part of another machine rather than as a single unit.

Other Embodiments

Although the representative embodiments of the present disclosure have been described above, the present disclosure is not limited to the above-described embodiments. For example, according to the present disclosure, the above-described embodiments may be modified as follows.

In the above-described embodiments, the sub-bearing member 16 is fixed to the bottom surface of the bottom portion 121*c* by the fastening bolts 18. However, the sub-bearing member 16 may be fixed to the bottom surface of the bottom portion 121*c* by any other means that is other than the fastening bolts 18.

In the above-described embodiments, there is described the example where the compressor 10 includes the main bearing aligning structure and the sub-bearing aligning structure. However, the main bearing aligning structure and the sub-bearing aligning structure are not essential components, and at least one of the main bearing aligning structure and the sub-bearing aligning structure may be eliminated.

In the above-described embodiments, there is described the example where each of the main bearing 361*a* and the sub-bearing 16*a* is formed as the sliding bearing. However, at least one of the main bearing 361*a* and the sub-bearing 16*a* may be formed as another type of bearing that is other than the sliding bearing.

In the above-described embodiments, there is described the example where the compressor 10 includes the scroll compression mechanism 30. However, the compressor 10 of the present disclosure is not limited to this. For example, a rotary compression mechanism 30 or a vane compression mechanism 30 may be employed.

In the above-described embodiments, there is described the example where the compressor 10 is applied to the refrigeration cycle device of the vehicle air conditioning device. However, the compressor 10 is not limited to this, and the compressor 10 may be widely applicable to temperature control devices used in houses, factories and the like. Moreover, the compressor 10 is not limited to a horizontal structure, in which the electric motor unit 20 and the compression mechanism 30 are arranged in the horizontal direction. For example, the structure of the compressor 10 may be a vertical structure, in which the electric motor unit 20 and the compression mechanism 30 are arranged in the up-to-down direction DRv.

Needless to say, in the above-described embodiments, the elements of each embodiment are not necessarily essential except when it is clearly indicated that they are essential and when they are clearly considered to be essential in principle.

In each of the above embodiments, when a numerical value such as the number, numerical value, amount, range or the like of the constituent elements of the embodiment is mentioned, the present disclosure should not be limited to such a numerical value unless it is clearly stated that it is essential and/or it is required in principle.

In each of the above embodiments, when the shape, positional relationship or the like of the constituent elements of the embodiment is mentioned, the present disclosure should not be limited such a shape or positional relationship unless it is clearly stated that it is essential and/or it is required in principle.

Conclusion

According to a first aspect presented in part or all of the above-described embodiments, a compressor includes a compression mechanism, an electric motor unit, a drive shaft and a housing. The housing includes a first housing, which is shaped in a bottomed tubular form and has an opening on one side in an axial direction of the drive shaft, and a second housing, which covers the opening of the first housing. A portion of the drive shaft, which is located on the one side in the axial direction, is rotatably supported by a main bearing, which is formed integrally in one-piece with or is fixed to a main bearing member of the compression mechanism. Another portion of the drive shaft, which is located on another side in the axial direction, is rotatably supported by a sub-bearing, which is formed integrally in one-piece with or is fixed to an inside of a body portion of a sub-bearing member. The compression mechanism, which includes the main bearing member, is placed at an inside of a tubular portion of the first housing. The sub-bearing member is formed separately from the first housing and is fixed to a bottom surface of a bottom portion of the first housing. According to this configuration, since the inner circumferential surface of the sub-bearing can be processed in a state where the sub-bearing member is removed from the housing, the inner circumferential surface of the sub-bearing can be processed with high precision without introducing the dedicated equipment. That is, since polishing of the sub-bearing can be performed in the unassembled state of the sub-bearing member, it is not necessary to increase the length of the shaft of the grindstone, and the high polishing precision of the sub-bearing can be ensured even with the relatively inexpensive general purpose equipment.

According to a second aspect, the sub-bearing member is fixed to the bottom surface of the bottom portion by a fastening bolt. According to this fastening method, the high fastening force can be obtained with the relatively small number of the assembling steps.

According to a third aspect, the compressor includes a sub-bearing aligning structure that is configured to coaxially align a central axis of the sub-bearing and a central axis of an inner circumferential surface of an insertion section of the tubular portion, wherein the insertion section is a section of the tubular portion to which the compression mechanism is inserted. According to this configuration, the misalignment between the central axis of the sub-bearing and the central axis of the inner circumferential surface of the tubular portion is limited. Therefore, a cumulative variation in the relative misalignment amount of the central axis of the respective bearings can be limited. As a result, it is possible to limit a localized contact pressure increase at each bearing and to ensure good oil film formation at each bearing. Therefore, the reliability of each bearing can be ensured.

According to a fourth aspect, the sub-bearing aligning structure includes a fitting structure, at which a projection formed at one of the first housing and the sub-bearing member is fitted into a recess formed at another one of the first housing and the sub-bearing member to position the sub-bearing member in place.

The projection and the recess of the fitting structure can be formed with high precision by machining using the general-purpose equipment, such as the lathe. Therefore, the positioning precision of the sub-bearing member can be ensured without introducing the dedicated equipment. Thus, the cumulative variation in the relative misalignment amount of the central axis of the respective bearings can be limited.

According to a fifth aspect, the sub-bearing aligning structure includes a pin fitting structure, at which a common positioning pin is fitted into each of a bottom wall hole formed at the bottom portion and a sub-bearing side hole formed at the sub-bearing member to position the sub-bearing member in place.

With this structure, the misalignment of the central axis of the sub-bearing relative to the central axis of the inner circumferential surface of the tubular portion can be limited, and the sub-bearing member can be positioned in place in the rotational direction by the positioning pin. Thus, assemblability of the sub-bearing member to the first housing can be sufficiently ensured.

According to a sixth aspect, the sub-bearing member is fixed to the bottom surface of the bottom portion in a state where a central axis of the sub-bearing and a central axis of an insertion section of the tubular portion, to which the compression mechanism is inserted, are coaxially aligned by an aligning jig that is configured to fit to an inner circumferential surface of the sub-bearing and an inner circumferential surface of the insertion section.

With this configuration, the positioning precision of the sub-bearing member can be ensured without adding the sub-bearing aligning structure to the compressor. Therefore, the cumulative variation in the relative misalignment amount of the central axis of the respective bearings can be limited.

According to a seventh aspect, the compressor includes a main bearing aligning structure that coaxially aligns a central axis of the main bearing and a central axis of an inner circumferential surface of an insertion section of the tubular portion, wherein the insertion section is a section of the tubular portion to which the compression mechanism is inserted. According to this configuration, the cumulative variation in the relative misalignment amount of the central axis of the respective bearings can be limited. As a result, it is possible to limit a localized contact pressure increase at each bearing and to ensure good oil film formation at each bearing. Therefore, the reliability of each bearing can be ensured.

According to an eighth aspect, the main bearing aligning structure includes a fitting structure, at which an outer periphery of the compression mechanism is fitted to the inner circumferential surface of the insertion section to position the main bearing member in place. The fitting structure of this type can be formed with high precision by machining using the general-purpose equipment such as the lathe. Therefore, the positioning precision of the main bearing member can be ensured without introducing the dedicated equipment. Thus, the cumulative variation in the relative misalignment amount of the central axis of the respective bearings can be limited.

According to a ninth aspect, the main bearing aligning structure includes a pin fitting structure, at which a common positioning pin is fitted into each of a housing hole formed at the first housing and a main bearing side hole formed at the main bearing member to position the main bearing member in place.

With this structure, the misalignment of the central axis of the main bearing relative to the central axis of the inner circumferential surface of the tubular portion can be limited, and the main bearing member can be positioned in place in the rotational direction by the positioning pin. Thus, assemblability of the sub-bearing member to the first housing can be sufficiently ensured. In addition, even when the drive force of the electric motor unit is applied to the compression mechanism, which includes the main bearing member, the positioning pin functions as the rotation stopper to limit dragged rotation of the main bearing member caused by the drive force of the electric motor unit.

According to a tenth aspect, at least one of the main bearing and the sub-bearing is a sliding bearing. With this configuration, the bearing of the drive shaft can be made more reliable against wear deterioration and have a longer service life while ensuring seizure resistance of the bearing of the drive shaft.

According to an eleventh aspect, the compression mechanism includes: a stationary scroll, which is fixed to the first housing; and an orbiting scroll, which is meshed with the stationary scroll and compresses the fluid when the orbiting scroll makes orbital motion in response to rotation of the drive shaft. According to the scroll compression mechanism with small torque fluctuation, the load on each bearing is limited. Thus, it is possible to ensure seizure resistance and wear resistance of each bearing.

According to a twelfth aspect, a method for manufacturing the compressor includes fixing the sub-bearing member to an inner surface of the bottom portion of the first housing in a state where the central axis of the sub-bearing and the central axis of the inner circumferential surface of the insertion section are coaxially aligned.

According to a thirteenth aspect, in the method for manufacturing the compressor, coaxially aligning of the central axis of the sub-bearing and the central axis of the inner circumferential surface of the insertion section is implemented by fitting an aligning jig to each of an inner circumferential surface of the sub-bearing and the inner circumferential surface of the insertion section. With this configuration, the positioning precision of the sub-bearing member can be ensured without adding the sub-bearing aligning structure to the compressor. Therefore, relative misalignment between the central axis of the main bearing and the central axis of the sub-bearing can be highly accurately limited.

What is claimed is:

1. A compressor comprising:

a compression mechanism that is configured to compress fluid;

an electric motor unit that is configured to output a drive force which drives the compression mechanism;

a drive shaft that is configured to transmit the drive force, which is outputted from the electric motor unit, to the compression mechanism; and a housing that receives the compression mechanism, the electric motor unit and the drive shaft, wherein:

the housing includes a first housing, which is shaped in a bottomed tubular form and has an opening on one side in an axial direction of the drive shaft, and a second housing, which covers the opening of the first housing;

a portion of the drive shaft, which is located on the one side in the axial direction, is rotatably supported by a main bearing, which is formed integrally in one-piece with or is fixed to a main bearing member of the compression mechanism;

another portion of the drive shaft, which is located on another side in the axial direction, is rotatably supported by a sub-bearing, which is formed integrally in one-piece with or is fixed to an inside of a body portion of a sub-bearing member, the body portion being shaped in a tubular form;

the compression mechanism, which includes the main bearing member, is placed at an inside of a tubular portion of the first housing;

the sub-bearing member is formed separately from the first housing and is fixed to a bottom surface of a bottom portion of the first housing;

the sub-bearing member is fixed to the bottom surface of the bottom portion by a fastening bolt;

the compressor comprises a sub-bearing aligning structure that is configured to coaxially align a central axis of the sub-bearing and a central axis of an inner circumferential surface of an insertion section of the tubular portion, the insertion section being a section of the tubular portion to which the compression mechanism is inserted;

the sub-bearing aligning structure includes a fitting structure, at which a projection formed at one of the first housing and the sub-bearing member is fitted into a recess formed at another one of the first housing and the sub-bearing member to position the sub-bearing member in place;

the first housing is formed integrally in one-piece; and the sub-bearing member is entirely received in the first housing.

2. The compressor according to claim 1, comprising a main bearing aligning structure that coaxially aligns a central axis of the main bearing and a central axis of an inner circumferential surface of an insertion section of the tubular portion, wherein the insertion section is a section of the tubular portion to which the compression mechanism is inserted.

3. The compressor according to claim 2, wherein the main bearing aligning structure includes a fitting structure, at which an outer periphery of the compression mechanism is fitted to the inner circumferential surface of the insertion section to position the main bearing member in place.

4. The compressor according to claim 2, wherein the main bearing aligning structure includes a pin fitting structure, at which a common positioning pin is fitted into each of a housing hole formed at the first housing and a main bearing side hole formed at the main bearing member to position the main bearing member in place.

5. The compressor according to claim 1, wherein at least one of the main bearing and the sub-bearing is a sliding bearing.

6. The compressor according to claim 1, wherein the compression mechanism includes:

a stationary scroll, which is fixed to the first housing; and an orbiting scroll, which is meshed with the stationary scroll and compresses the fluid when the orbiting scroll makes orbital motion in response to rotation of the drive shaft.

* * * * *